US007858044B2

(12) United States Patent
Coassin et al.

(10) Patent No.: US 7,858,044 B2
(45) Date of Patent: Dec. 28, 2010

(54) MULTI-WELL PLATE PROVIDING A HIGH-DENSITY STORAGE AND ASSAY PLATFORM

(75) Inventors: Peter J. Coassin, Encinitas, CA (US); Todd Bennett, San Diego, CA (US); Brian Grot, San Diego, CA (US); David Nicol, Anaheim, CA (US)

(73) Assignee: Nexus Biosystems, Inc., Poway, CA (US)

( * ) Notice: Subject to any disclaimer, the term of this patent is extended or adjusted under 35 U.S.C. 154(b) by 1397 days.

(21) Appl. No.: 10/837,219

(22) Filed: Apr. 30, 2004

(65) Prior Publication Data

US 2005/0048575 A1 Mar. 3, 2005

Related U.S. Application Data

(60) Provisional application No. 60/493,415, filed on Aug. 6, 2003, provisional application No. 60/466,998, filed on Apr. 30, 2003.

(51) Int. Cl.
*B01L 3/00* (2006.01)

(52) U.S. Cl. ..... 422/102; 422/99; 435/288.3; 435/288.4; 436/164; 436/172

(58) Field of Classification Search ..... 422/82.05, 422/99, 102, 104; 436/164, 172; 435/288.3, 435/288.4

See application file for complete search history.

(56) References Cited

U.S. PATENT DOCUMENTS

| | | | | |
|---|---|---|---|---|
| 5,910,287 | A * | 6/1999 | Cassin et al. | 422/102 |
| 6,171,780 | B1 * | 1/2001 | Pham et al. | 435/4 |
| 6,258,326 | B1 * | 7/2001 | Modlin | 422/102 |
| 6,426,050 | B1 * | 7/2002 | Pham et al. | 422/104 |
| 7,208,125 | B1 * | 4/2007 | Dong | 422/102 |
| 2002/0102617 | A1 * | 8/2002 | MacBeath et al. | 435/7.9 |
| 2005/0244305 | A1 * | 11/2005 | Fujita | 422/102 |

OTHER PUBLICATIONS

Abe et al., "Molecular Characterization of a Novel Metabotropic Glutamate Receptor mGluR5 Coupled to Inositol Phosphate/ $CA^{2+}$Signal Transduction", *The Journal of Biological Chemistry*, 267(19):13361-13368, Jul. 5, 1992.

(Continued)

*Primary Examiner*—Jill Warden
*Assistant Examiner*—Dwayne K Handy
(74) *Attorney, Agent, or Firm*—Eleanor M. Musick; Procopio, Cory, Hargreaves & Savitch LLP

(57) ABSTRACT

A dual-use, high density plate for storage and assays includes a frame including a matrix of wells. The matrix includes preferably 3456 wells with top portions being arranged preferably approximately flush with a plane of the frame. A solvent-resistant material such as cyclo-olefin polymer forms at least the bottom portions of the wells, and preferably the same solvent resistant material forms the frame, although varying from the bottoms of the wells by being rendered opaque. Evaporation control wells are preferably included at the periphery of the matrix for reducing effects of evaporation on edge wells.

145 Claims, 15 Drawing Sheets

OTHER PUBLICATIONS

Altenhofen et al., "Control of Ligand Specificity in Cyclic Nucleotide-Gated Channels from Rod Photoreceptors and Olfactory epithelium", *Proc. Natl. Acad. Sci.*, 88:9868-9872, Nov. 1991.
Berridge et al., "Inositol Trisphosphate, a Novel Second Messenger in Cellular Signal Transduction", *Nature*, 312:315-321, Nov. 1990.
Bettler et al., "Cloning of a Putative Glutatmate Receptor: A Low Affinity Kainate-Binding Subunit", *Neuron*, 8:257-265, Feb. 1992.
Bettler et al., "Cloning of a Novel Glutamate Receptor Subunit, GluR5: Expression in the Nervous System During Development", *Neuron*, 5:583-595, Nov. 1990.
Bonner et al., "Cloning and Expression of the Human and Rat m5 Muscarinic Acetylcholine Receptor Genes", *Neuron*, 1:403-410, Jul. 1998.
Boulter et al. "α3, α5 and β4: Three Members of the Rat Neuronal Nicotinic Acetylcholine Receptor-Related Gene Family Form a Gene Cluster", *The Journal of Biological Chemistry*, 265(8):4472-4482, Mar. 15, 1990.
Boulter et al., "Isolation of a cDNA Clone Coding For a Possible Neural Nicotinic Acetylcholine Receptor α-subunit", *Nature*, 319:368-374, 1986.
Boulter et al., "Molecular Cloning and Functional Expression of Glutamate Receptor Subunit Genes", *Science*, 249:1033-1037, 1990.
Bunzow et al., "Cloning and Expression of a Rat $D_2$ Dopamine Receptor cDNA", *Nature*, 336:783-787, Dec. 1988.
Campbell et al., "Phosphonate Ester Synthesis Using a Modified Mitsunobu Condensation", *J. Org. Chem.*, 59:658-660, 1994.
Chen et al., "'Analogous' Organic Synthesis of Small-Compound Libraries: Validation of Combinatorial Chemistry in Small-Molecule Synthesis", *J. Am. Soc.*, 116:2661-2662, 1994.
Chini et al., "Neuronal-type α-Bungarotoxin receptors and the $a_5$ -Nicotinic Receptor Subunit Gene Are Expressed in Neural and Nonneuronal Human Cell Lines", *Proc. Natl. Acad. Sci.*, 89:1572-1576, Mar. 1992.
Daluge et al., "1592U89, a Novel Carbocyclic Nucleoside Analog with Potent, Selective Anti-Human Immunodeficiency Virus Activity", *Antimicrobial Agents and Chemotherapy*, 41(5):1082-1093, May 1997.
Deneris et al., "$\beta_3$ : A New Member of Nicotinic Acetylcholine Receptor Gene Family Is Expressed in Brain", *The Journal of Biological Chemistry*, 264(11):6268-6272, Apr. 15, 1989.
Deneris et al., "Primary Structure and Expressed of β2: A Novel Subunit of Neuronal Nicotinic Acetylcholine Receptors", *Neuron*, 1:45-54, Mar. 1998.
DeWitt et al., "'Diversomers': An Approach to Nonpeptide, Nonoligomeric Chemical Diversity", 90:6909-6913, Aug. 1993.
Dhallan et al., "Primary Structure and Functional Expression of a Cyclic Nucleotide-Activated Channel from Olfactory Neurons", *Nature*, 347:184-187, Sep. 1990.
Dixon et al., "Cloning of the Gene and cDNA for Mammalian β-Adrenergic Receptor and Homology With Rhodopsin", *Nature*, 321:75-79, May 1986.
Duvoisin et al., The Functional Diversity of the Neuronal Nicotinic Acetylcholine Receptors Is Increased by a Novel Subunit: β4. Date Unknown.
Egebjerg et al., "Cloning of a cDNA for a Glutamate Receptor Subunit Activated By Kainate But Not AMPA",*Nature*, 351:745-748, Jun. 27, 1991.
Ellis et al., "Sequence and Expression of mRNAs Encoding, the $\alpha_2$ Subunits of a DHP-Sensitive Calcium Channel", *Science*, 241:1661-1664, Sep. 23, 1988.
Frielle et al., "Cloning of the cDNA for the Human $\beta_1$ -Adrenergic Receptor", *Proc. Natl. Acad. Sci.*, 84:7920-7924, Nov. 1987.
Goldman et al., "Members of a Nicotinic Acetylcholine Receptor Gene Family Are Expressed in Different Regions of the Mammalian Central Nervous System", *Cell*, 48:965-972, Mar. 27, 1997.
Herman, "Resonance Energy Transfer Microscopy, in: Fluroescence Microscopy of Living Cells in Culture, Part B" *Methods in Cell Biology*, ed. Taylor, D. L & Wang Y.-L., San Diego, Academic Press, 219-243, 1989.
Gordon et al., "Applications of Combinatorial Technologies to Drug Discovery, 2. Combinatorial Organic Synthesis, Library Screening Strategies, and Future Directions", *Journal of Medicinal Chemistry*, 37(10):1385-1401, May 13, 1994.
Hagihara et al., "Vinylogous Polypeptides: An Alternative Peptide Backbone", *J. Am. Chem. Soc.* 114(16):6569-6571, 1992.
Hirshmann et al., "Nonpeptidal Peptidomimetics with a α-D-Glucose Scaffolding. A Partial Somatostatin Agonist Bearing a Close Structural Relationship to a Potent, Selective Substance P Antagonist", *American Chemical Society*, 114:9217-9218, 1992.
Hollman et al., "Cloning by Functional Expression of a Member of the Glutamate Receptor Family", *Nature*, 342:643-648, Dec. 7, 1989.
Houamed et al., "Cloning, Expression, and Gene Structure of a G Protein-Coupled Glutamate Receptor From Rate Brain", *Science*, 252(5010):1318-1321, May 31, 1991.
Johnson et al., "Expression and Structure of the Human NGF Receptor", *Cell*, 47:545-554, Nov. 21, 1988.
Julius et al., "Molecular Characterization of a Functional cDNA Encoding the Serotonin 1 c Receptor", *Science*, 241:558-564, Jul. 29, 1988.
Julius et al., "The 5HT2 Receptor Defines a Family of Structurally Distinct but Functionally Conserved Serotonin Receptors", *Proc. Natl. Acad. Sci.*, 87:928-932, Feb. 1990.
Kayano et al., "Primary Structure of Rat Brain Sodium Channel III Deduced from the cDNA Sequence", 228(1):187-194, Feb. 1988.
Keinänen et al., "A Family of AMPA-Selective Glutamate Receptors", *Science*, 249:445-560, Aug. 3, 1990.
Kobilka et al., "Cloning, Sequencing, and Expression of the Gene Coding for the Human Platelet α-Adrenergic Receptor", *Science*, 238:650-565, Oct. 30, 1987.
Levitan et al., "Structural and Functional Basis for $GABA_A$ Receptor Heterogeneity", *Nature*, 335:76-79, Sep. 1, 1988.
Litt et al., "Localization of a Human Brain Sodium Channel Gene (SCN2A) to Chromosome 2", *Genomics*, 5:204-208:1989.
McDonough et al., "Effects of Corticosteroids on Articular Cartilage" *Physical Therapy*, 62(6):835-839, Jun. 6, 1982.
Meguro et al., "Functional Characterization of a Heteromeric NMDA Receptor Channel Expressed From Cloned cDNAs", *Nature*, 357:70-74, May 7, 1992.
McKinnon, "Isolation of a cDNA Clone Coding for a Putative Second Potassium Channel Indicates the Existence of a Gene Family", *The Journal of Biological Chemistry*, 264(14):8230-8236, May 15, 1989.
Monyer et al., "Heteromeric NMDA Receptors: Molecular and Functional Distinction of Subtypes", *Science*256:1217-1221, May 22, 1992.
Moriyoshi et al., "Molecular Cloning and Characterization of the Rat NMDA Receptor", *Nature*, 354:31-37, Nov. 7, 1991.
Noda et al., "Existence of Distinct Sodium Channel Messenger RNAs in Rat Brain," *Nature*, 320:188-192, Mar. 13, 1986.
Paulmichl et al., "New Mammalian Chloride Channel Identified by Expression Cloning," *Nature*, 356:239-241, Mar. 19, 1992.
Pritchett et al., "Importance of a Novel GABA Receptor Subunit for Benzodiazepine Pharmacology," *Nature*, 338:582-585, Apr. 13, 1989.
Ruth et al., "Primary Structure of the β Subunit of the DHP-Sensitive Calcium Channel from Skeletal Muscle," *Science*, 245:1115-1118, Sep. 8, 1989.
Schofield et al., "Sequence and Function Expression of the $GABA_A$ Receptor Shows a Ligand-Gated Receptor Super-Family," *Nature*, 328:221-227. Jul. 16, 1987.
Shaw et al., "The Influence of Corticosteroids on Normal and Papain-Treated Articular Cartilage in the Rabbit," *The Journal of Bone and Joint Surgery*, 55B(1):197-205, Feb. 1973.
Shivers et al., "Two Novel $GABA_A$ Receptor Subunits Exist in Distinct Neuronal Subpopulations," *Neuron*, 3:327-337, Sep. 1989.
Stillman et al., "Replication and Supercoiling of Simian Virus 40 DNA in Cell Extracts from Human Cells," *Molecular and Cellular Biology*, 5(8):2051-2060, Aug. 1985.
Stormann et al., Molecular Cloning and Expression of a Dopamine D2 Receptor from a Human Retina, *Molecular Pharmacology*, 37:1-6, Oct. 13, 1989.
Sugihara et al., "Structures and Properties of Seven Isoforms of the NMDA Receptor Generated by Alternative Splicing," *Biochemical and Biophysical Research Communications*, 185(3):826-832, Jun. 30, 1992.

Suthanthiran et al., "Immunosuppressants: Cellular and Molecular Mechanisms of Action," *American Journal of Kidney Diseases*38(2):159-172, Aug. 1996.

Tanabe et al., "Primary Structure of the Receptor for Calcium Channel Blockers from Skeletal Muscle," *Nature*, 328:313-318, Jul. 23, 1987.

Tanabe et al., "A Family of Metabotropic Glutamate Receptor," *Neuron*, 8:169-179, Jan. 1992.

Tempel et al., "Cloning of a Probable Potassium Channel Gene from Mouse Brain," *Nature*, 332:837-839, Apr. 28, 1988.

Thiemann et al., "A Chloride Channel Widely Expressed in Epithelial and Non-Epithelial Cells," *Nature*, 356:57-60, Mar. 5, 1992.

Turro, Modern Molecular Photochemistry: Energy Transfer: 9:296-361, Benjamin/Cummings Publishing Company, 1978.

Wada et al., "Functional Expression of a New Pharmacological Subtype of Brain Nicotinic Acetylcholine Receptor," *Science*, 240:330-334, Apr. 15, 1988.

Ymer et al., " $GABA_A$ Receptor β Subunit Heterogeneity: Functional Expression of Cloned cDNAs," *The EMBO Journal*, 8(6):1665-1670, 1989.

* cited by examiner

Aurora High Density Well Plate Stategy

Include evap wells in plate format

Basic Well Plate Row 8

Basic Well Plate Column 12

Total Wells 96

| Increased density Multiplier (rxc) | Well Spacing | # of Wells | Wells in Row | Wells in Column | Evaporation Barrier 2*r + 2*c + 4 | Total Wells/Microplate Assay wells + EvapWells |
|---|---|---|---|---|---|---|
| 1 | 1 | 9 | 96 | 8 | 12 | |
| 2 | 4 | 4.5000 | 384 | 16 | 24 | 84 | 468 |
| 3 | 9 | 3.0000 | 864 | 24 | 36 | 124 | 988 |
| 4 | 16 | 2.2500 | 1536 | 32 | 48 | 164 | 1700 |
| 5 | 25 | 1.8000 | 2400 | 40 | 60 | 204 | 2604 |
| 6 | 36 | 1.5000 | 3456 | 48 | 72 | 244 | 3700 |
| 7 | 49 | 1.2857 | 4704 | 56 | 84 | 284 | 4988 |
| 8 | 64 | 1.1250 | 6144 | 64 | 96 | 324 | 6468 |
| 9 | 81 | 1.0000 | 7776 | 72 | 108 | 364 | 8140 |
| 10 | 100 | 0.9000 | 9600 | 80 | 120 | 404 | 10004 |
| 11 | 121 | 0.8182 | 11616 | 88 | 132 | 444 | 12060 |
| 12 | 144 | 0.7500 | 13824 | 96 | 144 | 484 | 14308 |
| 13 | 169 | 0.6923 | 16224 | 104 | 156 | 524 | 16748 |

FIG. 9

MULTI-WELL PLATE PROVIDING A HIGH-DENSITY STORAGE AND ASSAY PLATFORM

RELATED APPLICATION DATA

This application claims the benefit of U.S. Provisional Application No. 60/466,998, filed Apr. 30, 2003, titled, DUAL-USE HIGH-DENSITY MICROPLATE, and U.S. Provisional Application No. 60/493,415, filed Aug. 6, 2003, titled, MULTI-WELL PLATE PROVIDING A HIGH-DENSITY STORAGE AND ASSAY PLATFORM, the contents of which are incorporated by reference in their entirety.

BACKGROUND OF THE INVENTION

1. Field of the Invention

The invention relates to multiple-well plates, and in particular to high density plates for compound storage and biological assay.

2. Description of the Related Art

A plate is a container with multiple liquid reservoirs. It may have two to several thousand reservoirs (also called wells) depending on the application. The most common configurations have 96 or 384 wells. The Society for Biomolecular Screening sets the standard for plate geometry. Plates typically maintain a 127.76×85.47 mm footprint regardless of the number of wells. The number and spacing of the wells has been standardized around the 96-well plate which has 8×12 wells spaced 9 mm center-to-center. Other plates are based on this pattern. To increase the well density, multiply the number of wells in the x- and y-directions of a 96-well plate by an integer and divide the 96-well spacing by this same integer. For example, a 3456-well plate has six times the number of wells in both the x- and y-directions (or the orthogonal axes along which the wells are aligned), giving it 48×72 wells spaced at 1.5 mm.

FIGS. 1*a*-1*b* schematically illustrate a low density multiple-well plate 2 (FIG. 1*a*) in comparison with a high density multiple-well plate 4 (FIG. 1*b*). The low density plate illustrated at FIG. 1*a* includes multiple wells 6 spaced apart by approximately 9 mm in each direction or at least in the x-direction as shown. Each well 6 then occupies a 9 mm by 9 mm area of the plate. The density of wells 6 on the plate 2 is then one well per 81 $mm^2$ or 0.012 wells/$mm^2$. The total dimension of the plate 2 in the x direction is shown as 127.76 mm and that in the y direction is shown as 85.47 mm. Wells are absent only within an outer periphery of the plate 2, and so the area of active wells may be around approximately 8000 $mm^2$. The total number of wells 6 that are fit onto the plate 2 is then the 8×12=96 wells 6 shown in FIG. 1*a*.

The high density plate 4 illustrated at FIG. 1*b* includes multiple wells 8 in each 9 mm by 9 mm portion of the plate 4, instead of the single well shown in FIG. 1*a*. For example, each 9 mm by 9 mm area of the plate 4 of FIG. 1*b* may include 6×6=36 wells 8. The density of wells 8 in plate 4 of FIG. 1*b* is thus 36 times the density of the wells 6 of the plate 2 of FIG. 1*a*, or 36×0.012 wells/$mm^2$ or 0.44 wells/$mm^2$. The total dimension of the plate 4 in the x direction is shown as 127.76 mm and that in the y direction is shown as 85.47 mm, or the same as that of the plate 2 of FIG. 1*a*. So, the total number of wells 8 formed on plate 4 would be 96×36=3456 wells. It follows that the sizes of the wells 8 will be reduced compared to the sizes of the wells 4 approximately corresponding with the increase in well density. For example, the wells 8 would have a smaller diameter than the wells 4 by a factor of about six.

In recent years, the advantages of increasing the number of wells per plate have become apparent. We have seen manufacturers producing and the industry using plates with 864, 1536, 3456, and 9600 wells for example. FIG. 9 shows a table which sets forth the progression of plate well number as squared integer multiples of 96. The table also sets forth the evaporation barrier well numbers to arrive at the total microplate well number that includes the integrated evaporation barrier wells. (Microplate Well Number Table) The benefit of these high-density plates is twofold. First, more wells per plate mean fewer plates used. This is especially important in operations like high-throughput drug screening where hundreds of thousands of experiments are routinely executed in a day. Second, smaller wells mean less material used which is preferable because some reagents are very expensive or difficult to make.

The technical requirements for performing a large number of chemical or biological assays in parallel in such applications as high-throughput chemical compound screening have lead to the development of high-density multi-well plates in which a large number of miniaturized, identical wells are present on a single platform or plate. Types of platforms, multi-well plates, and accessory items such as plate lids and caddies or carriers are described in U.S. Pat. No. 6,426,050 to Coassin et al, which is herein incorporated in its entirety by reference. In general, the plurality of wells on a single plate enables the construction, for example, of an identical composition of assay reaction components in each well. Then a different single chemical compound is added to each well in order to screen a large number of chemical compounds for biological or chemical activity. Other applications include construction of different assay compositions in the different wells and then the addition of the same chemical compound to the different wells in order to screen for different biological or chemical activities of a single compound. To facilitate the development of assay construction and measurement instrumentation for the purpose of automating that instrumentation, an industry-standard format has been proposed (Astle, T., "Standards in robotics and instrumentation", Journal of Biological Screening. Vol. 1, No. 4. pp. 163-169 (1996), which is herein incorporated by reference in its entirety) and maintained by the Microplate Standards Development Committee of the Society of Biomolecular Screening. The current revisions of this standard format, which comprise dimensional specifications for the footprint of the platform base, the height of the plate, and well dimensions and positions in the plate, provide a common set of useful definitions for the specification of multi-well platforms.

It is recognized in the present invention that it would be advantageous to make use of these definitions and standards for the positions of wells on the platform and for the height of the well bottom above the bottom of the supporting flange to enable compatibility with instrumentation configured for multi-well plates conforming to the proposed standard. In particular, it is further recognized that it would be advantageous to have a high-density planar array of wells in which the dimensions of the wells and their positions on the array are scaled according to the proposed standard. This would provide for ready modifications, typically in user-configurable software to enable compatibility with the wide range of automated instrumentation designed to be compliant with multi-well platforms manufactured to the proposed standard.

A number of multi-well platforms are commercially available for culturing cells, performing chemical or cellular assays, and for storing chemical compounds. Although many of these multi-well platforms offer necessary and desired features such as biocompatibility and low toxicity, substantial structural integrity and ease of manufacture, optical properties suitable for fluorescence and other spectrometric measurements, or chemical or thermal inertness, none of the present commercially available platforms offer all these desirable features combined into a single, multi-functional, low-cost plate. For example, Whatman Polyfiltronics offers a 96 well-format constructed of black polystyrene with a substantially optical-quality borosilicate Type II glass bottom that is suitable for fluorescence measurements due to the low intrinsic fluorescence of the bottom. The wall material of this plate, polystyrene, exhibits substantial autofluorescence at a wavelength of 460 nm when illuminated directly with light of 350 nm wavelength as taught by Coassin et al, U.S. Pat. No. 6,517,781, which is hereby incorporated in its entirety by reference. This intrinsic fluorescence of polystyrene adversely affects the sensitivity of a fluorescence assay when the well dimensions are decreased in a miniaturized, high-density format, because each well is supported by sufficient autofluorescent material to maintain the structural rigidity of the wall.

Adhesives used to bond glass and other transparent materials to the polystyrene plate bottom are soluble in ethanol and other solvents routinely used in chemical screening, thus limiting the functionality of the plate for storing concentrates of chemical compounds. The use of glass bottoms has proven optimal for spectrometric assays due to their high transmittance of light wavelengths most typically employed in chemical and biological assays (300 to 800 nm). Sealing the glass to the plastic to the interstitial material of the plate, however, may limit the use of the plate to particular reagents or solvents for reagents as well as the physical conditions such as temperature for storage or assay. One of the most common solvents used for storing chemical compound concentrates is dimethylsulfoxide (DMSO). Many adhesives and structural materials used in multi-well plate construction are not resistant to DMSO, so that plates used for chemical storage are typically constructed from materials such as polypropylene that are selected primarily on the basis of chemical resistance. These plate materials, although compatible with chemical storage, are typically not transparent and hence not useful for fluorescence assays.

Another problem is the potential chemical incompatibility of the material in an otherwise fluorescence-quality assay plate to the solvent such as DMSO used to maintain the chemical compound concentrate. The typical way this problem is addressed is by predilution of the concentrate from the storage plate into a diluent that is compatible with the assay plate, such as a buffer or other aqueous medium. But this requires the expenditure of an intermediate multi-well plate to perform the dilution, with its attendant compound management issue of keeping track of which wells receive which compound. Moreover, the attendant drawback of intermediate dilution is the decreased concentration of chemical compound that ultimately reached the assay. The intermediate dilution may be diluted further on the addition of other assay reagents or biological cells or other assay constituents that may be precluded from being present in the intermediate diluent. It is recognized in the present invention that it would be advantageous to have a system that overcomes these problems and difficulties by enabling the use of the same type of plate for both storing the compounds and assaying their activity.

It is further recognized in the present invention that it would be advantageous to provide a mechanically strong material for both the walls of the wells and the plate bottom. It is well appreciated by those skilled in the art that mechanical constraints are imposed when different materials are bonded together to achieve desired optical characteristics. For example, the differential thermal expansivities of glass and plastic result in their eventual detachment when subjected to repeated steam sterilization cycles to render a plate suitable for cell culture. Different materials are typically used in different parts of multi-well plates to achieve necessary mechanical or optical properties in those parts. The different abilities of these different materials to withstand mechanical stresses may however limit the usefulness of a particular plate designed and manufactured with optimization of only one property.

A difficulty encountered with small wells in high density plates is that many instruments designed to work with large wells in low-density plates no longer function properly when used to access small wells, largely because the instrument must generally be aligned more precisely with a small well than with a large one, all else being equal. Liquid handling instruments have other difficulties as well. First, for a pipette tip to fit into a small well, it must be thin, and thin pipette tips clog and break easily. Second, as the volume of liquid decreases, standard pipetting becomes less and less accurate and eventually fails altogether as surface tension becomes the dominant force.

Another issue that arises when dealing with small wells is evaporation. First is the difference in exposed liquid surface area between a large well and a small one. The ratio of surface area to volume in the well of a 3456-well plate is about four times that of a 96-well plate. For 3456-well plates and 96-well plates, this assumes well diameters of 1 mm and 7 mm with fill volumes of 2 μL and 200 μL respectively. Since evaporation rate is directly proportional to exposed surface area, a 1 mm diameter well would lose about 40% of its volume in the same time that a 7 mm well would lose 10%, assuming that all other conditions are the same. This brings us to a second evaporation issue that is recognized by the inventors in the present invention: all other conditions are generally not the same. In a lidded plate, small wells at the plate edges evaporate significantly faster than small wells at the interior of the same plate, which can be detrimental to an experiment being run or a chemical being stored in a plate.

In a plate with a lid, there is a small gap between the lid and the tops of the wells. In the interior of the plate, the liquid in the wells evaporates and becomes vapor, the partial pressure of that vapor increases in the space above the wells. This occurs until the system reaches equilibrium, at which point the liquid will cease to evaporate. The situation is different at the edges of the plate. Here the vapor being created diffuses away from the well and into the outside environment. The system does not reach equilibrium; instead, liquid continues to evaporate and vapor continues to diffuse away indefinitely. Small wells at the edge of the plate experience this phenomenon more drastically than large wells because their average distance from the edge is significantly shorter. A product referred to as a NanoWell Assay Plate manufactured by Aurora Biosciences Corporation has peripheral troughs designed to be filled with liquid to mitigate evaporation from wells at the edge of the plate. However, these troughs are difficult to fill, especially with automated equipment, and liquid in them tends to spill out easily. It is recognized in the present invention that it would be advantageous to have an improved high density, multiple-well plate that experiences reduced evaporation from peripheral wells.

Because high-density plates have so many wells, they lend themselves to applications where large numbers of different samples need to be interrogated. In high-throughput drug screening, for example, hundreds of thousands of distinct compounds are assayed for biological activity against a specific disease target. A typical pharmaceutical company will screen their compound library against perhaps hundreds of targets per year, generating tens of millions of data points. As mentioned, compounds are usually stored in 96- or 384-well plates and transferred into an assay plate with a pipetting device. Currently, only a small percentage of the pharmaceutical industry uses high-density plates for screening because of the difficulties mentioned above.

SUMMARY OF THE INVENTION

In view of the above, a dual-use, high-density plate for compound storage and assays includes a frame and a matrix of more than 384 active wells. The active wells of the matrix are defined by walls disposed within the frame and bottom portions comprising a solvent resistant material. The solvent resistant material is preferably DMSO-resistant, and preferably comprises cyclo-olefin polymer. The frame including the walls of the active wells is also preferably formed of a solvent resistant material, e.g., a DMSO-resistant material such as cyclo-olefin polymer. As described below, the frame material and the material of the bottoms of the wells may be different solvent- or DMSO-resistant, cyclo-olefin polymer materials, or different modifications or process variations of a same material, e.g., to preferably at least provide a plate with opaque well walls and well bottoms exhibiting substantial transmittance.

The matrix preferably further includes multiple evaporation control wells or "dummy" wells. The dummy wells are preferably also defined by walls disposed within the frame outside of the matrix of active wells. The dummy wells preferably form a ring around the active matrix. The dummy wells are preferably further defined by bottom portions not comprising the same solvent-resistant material that defines the bottoms of active wells, or the materials are modifications or process variations of a same material, or at least they preferably differ in that the bottoms of the dummy wells are opaque. The material of the bottom portions of the dummy wells is preferably substantially opaque to screening wavelengths, e.g., between 200 nm and 800 nm, and further preferably between 230 nm and 600 nm. The bottom portions of the dummy wells preferably have greater thicknesses than bottom portions of the active wells. This material forming the bottom portions of dummy wells may be preferably part of the frame, and may include a same material as the walls defining the dummy wells. The bottom portions and the walls that define the dummy wells may be integrally formed of a unitary construction with the frame.

A trough may be formed peripheral to the active wells, and may preferably surround the active wells. The trough also preferably is located outside the dummy wells. When the preferred plate is acting in storage mode, a lid is disposed over the top portions of the wells. This lid may have a protrusion that forms a labyrinth with the trough.

Multiple optical fiducials may be formed within the frame for reflecting light from a light source for a camera. The optical fiducials may have a convex shape with respect to the light source and be polished for increased reflectivity. The optical fiducials are preferably formed as molded portions of the frame, and disposed approximately at corner portions of the frame.

Top portions of the wells are preferably arranged at least approximately flush with a plane of the frame. The number of wells of the plate is preferably more than 384 wells, and may be preferably 1536 wells or more, and may be preferably 3456 or more and have an interior fill volume of approximately 2 microliters or less. The DMSO-resistant material is preferably substantially transparent to screening wavelengths, e.g., between 200 nm and 800 nm, and further preferably between 230 nm and 600 nm. The plate preferably remains substantially flat at temperatures up to 110° C. or higher, and more preferably greater than 120° C. or 125° C., and even at temperatures as high as 127° C. or more.

A method of performing an assay and/or storing liquid in a plate is also provided, as may preferably include one or more of the advantageous features described above or below herein or may be a plate as otherwise understood by those skilled in the art or may be a conventional plate. The method would designate a periphery of dummy wells that are otherwise different from, similar to or identical to other "active" wells forming the matrix. That is, the wells that are designated as dummy wells would not be used in the assay process or in the storage of liquid to be used or analyzed, particularly due to the accelerated evaporation that occurs from these small, edge wells, and/or measurements using the dummy wells would not be used in the analysis or in results of the analysis.

A multi-well plate is further provided including a frame and a matrix of more than 384 active wells defined by walls disposed within the frame and bottom portions comprising a cyclo-olefin polymer. The cyclo-olefin polymer comprises cycloalkane and polyethylene monomers polymerized catalyst-free with thermally activated moieties functionalized to said monomers.

A multi-well plate is further provided including a frame and a matrix of more than 384 active wells defined by walls disposed within the frame and bottom portions comprising a cyclo-olefin polymer. The cyclo-olefin polymer has an absorbance of 0.1/mm or less at wavelengths in a range between 230 nm and 280 nm.

A multi-well plate is further provided including a frame and a matrix of more than 384 active wells defined by walls disposed within the frame and bottom portions comprising a cyclo-olefin polymer. The cyclo-olefin polymer has an absorbance of 0.05/mm or less at wavelengths of 280 nm or more.

A multi-well plate is further provided including a frame and a matrix of more than 384 active wells defined by walls disposed within the frame and bottom portions comprising a cyclo-olefin polymer. The bottom portions have a thickness of 1 mm or less and a transmittance at 1 mm of 40% or more at wavelengths in a range between 220 nm and 260 nm. The bottoms of the wells may have a thickness particularly between 50 μm and 300 μm.

A multi-well plate is further provided including a frame and a matrix of more than 384 active wells defined by walls disposed within the frame and bottom portions comprising a cyclo-olefin polymer. The bottom portions have a thickness of 1 mm or less and a transmittance at 1 mm of 80% or more at wavelengths of 260 nm or more. The bottoms of the wells may have a thickness particularly between 50 μm and 300 μm.

The cyclo-olefin polymer of any of the above plates may have less than 1% change in transmittance upon exposure to steam; less than 0.5 $gm/m^2$ per 24 hr water vapor permeability; a tensile modulus greater than 1 GPa; a mold shrinkage of 0.6% or less; a melt viscosity less than 2000 Pa-s at a shear rate of 10/s at 200° C.; a water contact angle greater than 90° of arc; a heat distortion temperature of more than 110° C., or particularly more than 120° C. or 125° C., or substantially 127° C. or more, or combinations thereof.

A multi-well plate is further provided including a frame and a matrix of more than 384 active wells defined by walls disposed within the frame and bottom portions comprising a same solvent resistant material, except that the walls are rendered opaque at screening wavelengths. The walls are rendered opaque by exposure to air at substantially 200° C. or higher, or adding dark pigment, or a combination thereof. The bottoms of the wells have a transmittance of 40% or more at screening wavelengths of 220 nm or more and have a thickness of 1 mm or less. Particularly preferred screening wavelengths are below 600 nm and above 330 nm.

The dark pigment may comprise carbon black particles at a weight percentage ranging between 0.5% and 15%. The exposure to air may be followed by quenching with molecular nitrogen. The plate may be formed by injection molding, and may further include a flange at a periphery of said matrix of wells.

Center-to-center distances between adjacent wells may be greater than diameters of wells. The matrix preferably includes more than 384 wells, and may be preferably substantially 3456 wells, and the center-to-center distances may be 1.3 mm or less, and the diameters may be 1.03 mm or less. The matrix may include substantially 1536 wells, and the center-to-center distances may be 2.25 mm or less, and the diameters may be 1.8 mm or less. The matrix may include more than 3456 wells, and corresponding center to center distance and diameter scales and ratios to those described with regard to the 1536 and 3456 well plates.

The plate may have a thickness in a range between 0.5 mm and 14 mm. The plate may have a thickness substantially around 3 mm. The wells may have a draft angle substantially around 2° or more.

The solvent-resistant material may have a less than 1% change in transmittance upon exposure to steam; less than 0.5 $gm/m^2$ per 24 hr water vapor permeability; a tensile modulus greater than 1 GPa; a mold shrinkage of 0.6% or less; a melt viscosity less than 2000 Pa-s at a shear rate of 10/s at 200° C.; a water contact angle greater than 90° of arc; a heat distortion temperature of more than 110° C., or particularly more than 120° C. or 125° C., or substantially 127° C. or more, or combinations thereof.

A multi-well plate is further provided including a frame and a matrix of more than 384 active wells defined by walls disposed within the frame and bottom portions comprising a DMSO-resistant material having a heat distortion temperature of more than 110° C., or particularly more than 120° C. or 125° C., or substantially 127° C. or more. The material may comprise cyclo-olefin polymer.

A multi-well plate is further provided including a frame and a matrix of more than 384 active wells defined by walls disposed within the frame and bottom portions comprising a same solvent resistant material, except that the walls are rendered opaque at screening wavelengths, and the bottoms of the wells have a transmittance of 40% or more at screening wavelengths of 220 nm or more and have a thickness of 1 mm or less. The walls may be rendered opaque by adding a dark pigment comprising carbon black particles at a weight percentage ranging between 0.5% and 15%. The walls may also be rendered opaque by exposure to air being followed by quenching with molecular nitrogen.

A method of manufacturing the dual-use, high density plate according to any or all of the above may include pre-extruding a clear film comprising the solvent-resistant or DMSO-resistant material for forming the bottom portions of the wells, placing the clear film into the mold, and injecting a body material into the mold after placing the clear film into the mold. Alternative manufacturing methods are understood to those skilled in the art.

A plate according to any or all of the above is preferably formed of a material that exhibits low auto-fluorescence. Preferably, that material exhibits autofluorescence at screening wavelengths below 5%, and more preferably below 4%, and further substantially 3% or less.

The following references are, in addition to that which is described as background, the invention summary, brief description of the drawings and the abstract, hereby incorporated by reference into the detailed description of the preferred embodiments below, as disclosing alternative embodiments of elements or features of the preferred embodiments not otherwise set forth in detail below. A single one or a combination of two or more of these references may be consulted to obtain a variation of the preferred embodiments described in the detailed description herein:

U.S. Pat. Nos. 6,517,781, 6,463,647, 6,426,050, 6,232,114, 6,229,603, 6,018,388, 5,583,211, 5,278,238, 4,874,808, 4,918,133, 4,935,475, 4,948,856, 5,115,052, 5,206,306, 5,270,393, 5,272,235, 5,278,214, 5,534,606, 5,532,030, 4,689,380, 4,899,005, 4,002,815, 4,069,376, 4,110,528, 4,262,103, 4,380,617, 4,426,502, 5,589,351, 5,355,215, 4,004,150, 4,154,795, 4,251,159, 4,276,259, 4,431,307, 4,468,974. 4,545,958, 4,652,553, 4,657,867, 4,707,454, 4,735,778, 4,741,619, 4,751,530, 4,770,856, 4,797,259, 4,828,386, 4,892,409, 4,948,442, 4,956,150, 4,968,625, 4,994,354, 5,041,266, 5,047,215, 5,084,246, 5,110,556, 5,147,780, 5,149,654, 5,241,012, 5,294,795, 5,319,436, 5,395,869, 5,428,098, 5,456,360, 5,487,872, 5,496,502, 5,516,490, 5,540,891, 5,545,528, 5,604,130, 5,609,826, and 5,858,309;

U.S. design Pat. Nos. D265,124, D266,589, D269,702, D288, 604, and D317,360; and PCT Publications No. WO 96/30540 (Tsien), WO 93/13423 (Akong), WO 86/07606, WO 92/01513, WO 92/01553, WO 94/23839, WO 95/22406, and WO 96/39481; and Sambrook et al., Molecular Cloning: A Laboratory Manual, 2d ed. (1989) Cold Spring Harbor Laboratory Press, Cold Spring Harbor, N.Y.;

Lakowicz, J. R., Principles of Fluorescence Spectroscopy, New York, Plenum Press (1983);

McGraw Dictionary of Chemical Terms (ed. Parker, S. 1985), McGraw-Hill, San Francisco;

Zeon Corporation. 2002. Technical Report: Zeonex and Zeonor Technology Applications. Zeon Corporation;

Zeon Corporation Product Brochure Cyclo-olefin Polymer Zeonex 2001 Zeon Corporation Herman, B., Resonance Energy Transfer Microscopy, in: Fluorescence Microscopy of Living Cells in Culture, Part B, Methods in Cell Biology, vol. 30, ed Taylor, D. L. & Want, Y. L., San Diego: academic Press (1989), pp. 219-243;

Turro, N. J., Modern Molecular Photochemistry, Menlo Park: Benjamin/Cummings Publishing Col. Inc. (1978), pp. 296-361;

Astle, T., Standards in robotics and instrumentation. Journal of Biological Screening. 1 (4):163-169 (1996); and Molecular Probes catalog (1997), OR, USA.

BRIEF DESCRIPTION OF THE DRAWINGS

FIGS. 6*a*-6*f* schematically illustrate top, bottom, front, rear and opposing side views of a multiple-well plate in accordance with a preferred embodiment.

FIG. 9 is a Microplate Well Number Table.

DETAILED DESCRIPTION OF THE PREFERRED EMBODIMENTS

Figure 1A:
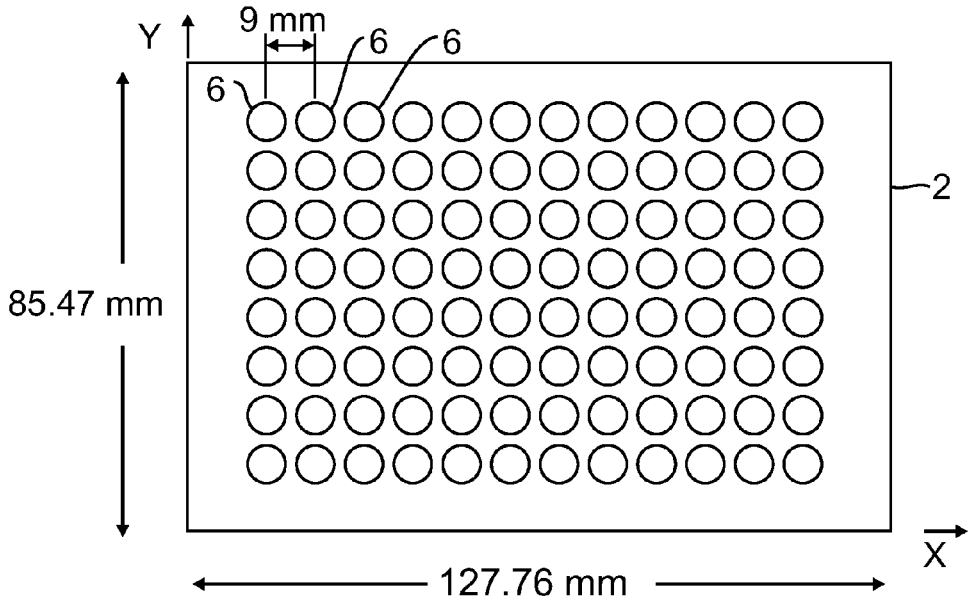
FIG. 1*a* schematically illustrates a top view of a low-density multiple-well plate in accordance with the prior art.
Figure 1B:
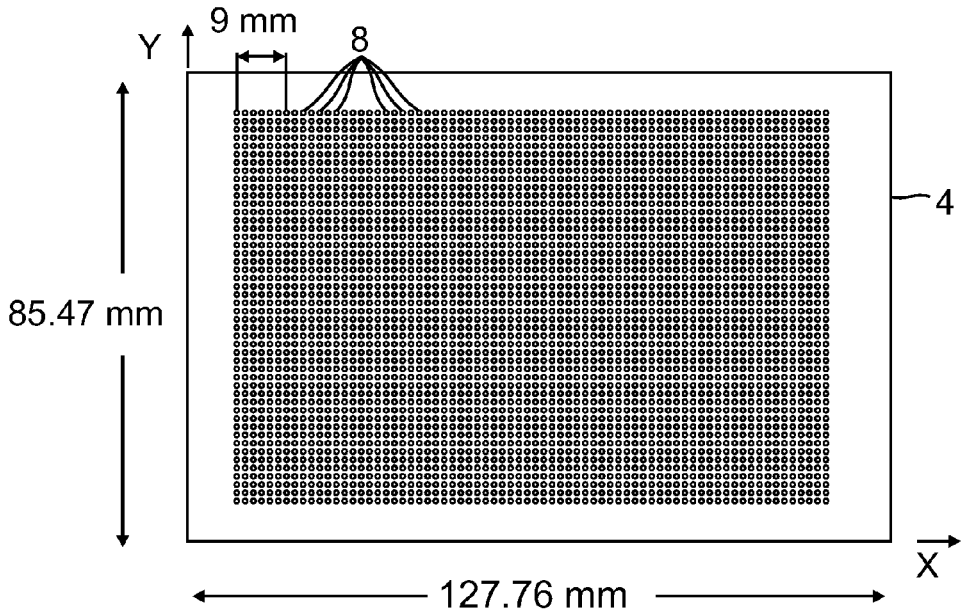
FIG. 1*b* schematically illustrates a top view of a high density multiple-well plate including a matrix of small wells compared with the wells of the low density plate of FIG. 1*a*.

Preferred embodiments set forth below include multiple-well plates including multiple wells disposed within platforms. Each well in the multi-well plate of the preferred embodiment has opaque sides and a transparent or substantially transparent bottom suitable for spectroscopic measurements of biological and biochemical samples. The material or materials or preferably different process variations and/or modifications of a same material, namely cyclo-olefin polymer or copolymer, comprising the well walls and bottoms of the wells preferably also have sufficient thermal, mechanical, and chemical resistance to enable storage of chemical samples and biological cells. It is noted that the preferred material is referred to herein as cyclo-olefin polymer throughout the specification and in the claims. When that term is used, it is meant to include cyclo-olefin olefin polymer (COP) and cyclo-olefin copolymer (COC), unless expressly distinguished in an example or otherwise.

The wells of the plate are arrayed in a planar pattern to provide high-density, low-volume formats for automated liquid chemical handling and assay systems capable of manipulating and assaying in parallel total liquid volumes of 5 mL or less. The side and bottom materials of the wells exhibit low fluorescence when illuminated with screening wavelengths, e.g., in the ultraviolet or visible, and have high transmittance to these wavelengths for the purposes of fluorescence excitation and the reading of subsequent fluorescence emission through the well bottom. Exemplary screening wavelengths employed with plates in accordance with preferred embodiments include 337 nm, 360 nm, 400 nm, 405 nm, 430 nm, 460 nm, 480 nm, 485 nm, 520 nm, 530 nm, 535 nm, and 590 nm. As understood, wavelengths between approximately 200 nm and 800 nm may be used for screening using a plate in accordance with a preferred embodiment.

The heat resistance of the plate material provides for thermal sterilization so that cells can be maintained without contamination, and its chemical resistance enables concentrates of chemical compounds in various solvents to be stored without contamination. The preferred plate also incorporates an arrangement of wells not used for assay or chemical storage, but which contain an assay liquid or storage solvent to mitigate evaporation of liquid in the wells used for chemical storage or assay. In addition, the preferred plate includes additional useful features such as indentations for the accommodation of lids to maintain a closed environment surrounding the liquid contents of the wells, and markings to enable optically guided automated alignment of the plate with instrumentation.

Multi-well platforms and assay plates according to preferred embodiments are used for spectrometric assays, as platforms used for storage of chemical compounds and in methods for using such platforms. These multi-well platforms are particularly useful for fluorescence measurements of chemical or biological samples comprising a total liquid volume of 1 mL or less. The multi-well platforms are also useful for the storage of small liquid volumes of chemical compounds at high concentrations. The multi-well platforms can be used in automated and integrated systems in which small volumes of stored chemical compounds are transferred from one multi-well platform used for storage purposes to another multi-well platform used to construct assays for chemical or biological activities of those same compounds, particularly automated screening of low-volume samples for new medicines, agrochemicals, food additives, and cosmetics.

Another feature of a plate in accordance with a preferred embodiment is the usefulness of the multi-well plate for chemical storage, as a container for miniaturized fluorescence assays, and other aspects of chemical and biological screening. Having one plate that enables different functions overcomes several difficulties and impediments encountered in the screening of chemical compounds for biological activity. A difficulty with conventional systems that utilize multiple well plates is in administration or keeping track of the chemical compounds assayed on a particular high density multi-well platform when the compound concentrates are maintained in multi-well plates that have lower density than the assay plate. For example, an assay plate comprising 3456 wells arrayed in the proposed standard compatible 48×72 matrix can accept the different chemical compounds stored in 36 standard 96-well (8×12) plates, e.g., with a different compound in each well or in 9 standard 384-well (16×24) well plates, e.g. A plate in accordance with a preferred embodiment affords a one-to-one direct spatial correspondence between wells in the assay and storage plates, because the same type of plate is preferably and advantageously used for both functions.

Another feature of a plate in accordance with a preferred embodiment is the use of a single material that combines desirable optical, mechanical, and chemical inertness and resistance properties so that the same plate can be inexpensively manufactured and then utilized for the various different tasks of automated chemical compound screening. Some advantageous properties of a plate in accordance with a preferred embodiment include one or more and preferably all of the following:

(1) Low intrinsic fluorescence when illuminated by light with wavelengths ranging from 300 to 800 nm;

(2) High transmittance of light with wavelengths over the same range to enable a wide range of fluorescent probes to be used in different spectrometric assays;

(3) Minimal change (e.g., less than about 1%) in optical transmittance after exposure to steam, e.g., to enable sterilization;

(4) Low water vapor permeability (e.g., less than about 0.5 $gm/m^2$ per 24 hr) to enable assays to be constructed and then stored for periods of time so that biological or chemical reactions required for measuring the output of the assays are able to ensue without loss of sample volume;

(5) Large impact, tensile and flexural strengths (e.g., tensile modulus greater than about 1 GPa) to withstand the various manipulations necessary for plate construction and to prevent plate deformation during automated conveyance and handling by robots;

(6) Low mold shrinkage (e.g., less than about 0.4%) and low melt viscosity (e.g., less than about 2000 Pa-s at a shear rate of 10/s at 200°) to allow manufacture of small (e.g., less than about 1 mm) features on the plate to specified tolerances;

(7) High resistance to DMSO and other solvents used to maintain dissolved chemical compound concentrates;

(8) Low toxicity to cells; and (9) Low interaction with chemical or biochemical compounds or agents in an assay to prevent their adsorptive loss to the well wall (e.g., water contact angle greater than about 90 degrees of arc).

A general material type that is preferred as meeting these desired properties for multi-well arrays and platforms is or includes cyclo-olefin copolymer (COC). Cyclo-olefin polymer (COP) and copolymer (COC) are advantageous and alternatively preferred materials. Coassin et al. (U.S. Pat. No. 6,232,114, incorporated by reference) describe COC materials that offer optical properties such as low intrinsic fluorescence and high transparency at wavelengths typically used in chemical and biological fluorescence assays. In their Tables 2 and 3, they show that the intrinsic fluorescence over the wavelength range of 400 to 600 nm of clear COC illuminated by light of 315 or 350 nm wavelength is about 1.5 times that of the same thickness of glass and about 0.5 times that of the same thickness of polystyrene. Therefore, clear COC provides optical qualities desired in an acceptable substitute for glass in miniaturized assays in multi-well plates while also providing superior qualities to polystyrene, which is typically used as a substitute for glass. COC is readily rendered optically opaque by heating the copolymer resin to 280° C. in the presence of air to produce carbon black in the interstices. This enables the wall material to be composed of a preferably otherwise same chemical material as an optically transparent bottom so that fluorescence measurements through the bottom of one well are not contaminated by stray light emitted by the assays staged in the surrounding well. Coassin et al. teach numerous techniques and methods for the copolymerization of COC and molding into shapes for the manufacture of multi-well plates.

The preferred embodiment exploits the properties of COC resins for the composition of an advantageous multi-well plate that is capable of multiple functions in the automated chemical compound screening process. These functions include the management of the chemical compounds, particularly rare compounds in which only small volumes (e.g., less than about 10 mL) of the compound concentrate are suitable for preparation at one time due to the scarcity of the compound, as well as the staging of assays for biological function in small volumes from which spectrometric measurements of high quality are required.

An advantageous multi-well microtiter platform or plate is provided in accordance with a preferred embodiment which is capable of performing the diverse functions involved in high-throughput screening of chemical compounds for desired chemical or biological properties. These functions of the plate include providing a storage repository for the chemical compounds to be tested as well as an assay container with superior performance for spectrometric measurement, especially fluorescence. Additional features of the preferred plate is superior mechanical properties for automated handling in the construction and measurement of assays, as well as efficient and rapid manufacturability. A plate in accordance with a preferred embodiment includes a multi-well platform suitable for multiple functions including chemical storage and spectrometric measurements and includes miniaturized wells arranged in a planar array with dimensions and center-to-enter spacing consistent with the scalable dimensions described in the proposed microtiter plate standard. The platform includes a layer of opaque material of low intrinsic fluorescence, when illuminated with light in the wavelength range of 300 to 700 nm, in which the wells are disposed, and a layer of transparent material of low intrinsic fluorescence and high transmittance that is applied to the bottom of the opaque layer as a sheet to permit each well to contain liquids without leakage and to provide a window for spectrometric measurements. The platform is constructed of a material such as cyclo-olefin copolymer that provides sufficient mechanical rigidity to allow repeated handling and maneuvering with automated transport and positioning instrumentation. The material also provides resistance to temperature sufficient to enable sterilization by steam for the aseptic culture of isolated cells. The material is sufficiently resistant to chemical solvents such as DMSO so that minute volumes of chemical compound concentrates can be stored for long periods without either impairment of the structural integrity of the platform or adsorption of the molecular contents of the concentrate on the well surface.

Figure 2A:
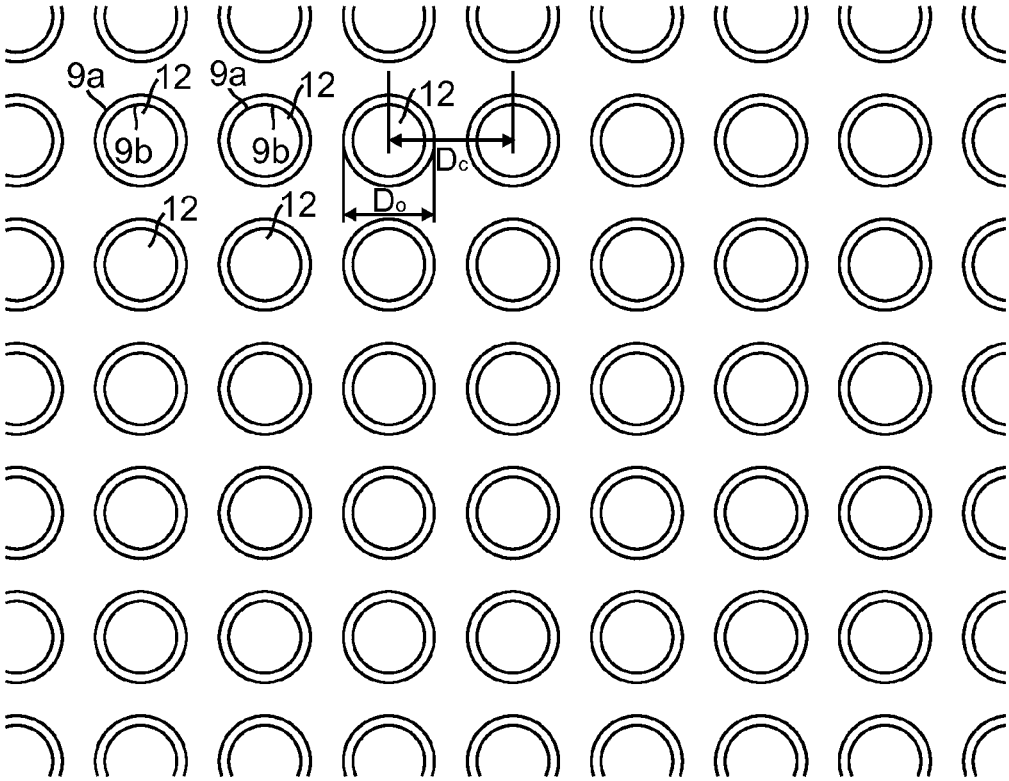
FIG. 2*a* schematically illustrates an enlarged top view of a portion of wells of a multiple-well plate in accordance with a preferred embodiment.

With reference now to FIG. 2*a*, there is shown a rectangular array of concentric circles, which illustrate a view of the top of a platform in accordance with a preferred embodiment looking down on the well array. The wells 12 are arranged on a rectangular grid. The wells 12 are formed in a planar slab of material that provides rigid support for the well walls. Each well 12 is a circularly symmetric void that completely penetrates from top to bottom the solid material used to construct the platform and so forms a honeycomb plate. The outer circle 9*a* of each pair of concentric circles represents the top rim of the well 8 on the top surface of the plate. The inner circle 9*b* of each pair of concentric circles denotes the bottom rim of the well on the bottom surface of the platform as seen when viewed from the top surface. The well 12 preferably has the shape of the frustum of an inverted cone and so the well wall has a draft angle with respect to the longitudinal axis of the well that extends from the center of the circle defining the top rim of the well to the center of the circle defining the bottom rim of the well. The diameter of the well at the bottom of the plate is smaller than the well diameter at the top of the plate to facilitate removal of the pin used to mold the well shape.

In one embodiment, the spacing between the centers of any two adjacent wells situated along a row or column of the array is an integral subdivision of the 9 mm center-to-center spacing defined for the 8×12 well array of the 96-well plate described in the proposed microplate standard. This is to facilitate ready use of the plate by liquid-handling and fluorescence measurement instrumentation manufactured in accordance with the standard. In a preferred embodiment of a high density plate, e.g., as illustrated in part at FIG. 2*a*, the well center-to-well center spacing $D_c$ is no greater than 1.5 mm, to accommodate an array of at least 48×72 sample wells (a total of at least 3456 sample wells). To provide structural rigidity to the well walls, the top rim diameter $D_o$ is smaller than the center-to-center spacing $D_c$ between the well centers, or $D_o<D_c$ (see FIG. 2*a*), so that in the preferred embodiment, the diameter $D_o$ of the well at the top rim is preferably 1.3 mm or less. In FIG. 2*a*, the depicted top diameter $D_o$ of the well is preferably 1.1 mm and the bottom diameter is preferably 0.87 mm. In a second preferred embodiment, the center-to-center spacing $D_c$ of the sample wells is 2.25 mm, which accommodates an array of 32×48 wells (1536 total wells). This enables the well diameter $D_o$ at the top surface to be on the order of 1.8 mm to ensure rigidity of the well wall.

The thickness of the platform comprising the well array is preferably selected to meet the desired requirements for the volume of each well to accommodate the liquid sample and the rigidity of the resulting platform to maintain a desired flatness of the top and bottom surfaces and to avoid deformation of the well walls. In the preferred embodiment, the thickness of the platform is about 3 mm, but thinner (0.5 mm) or thicker (up to 14 mm) platforms can be accommodated in the concepts of this design. With a 3 mm thickness, the draft angle of the 1.1 mm top diameter $D_o$ and 0.87 mm bottom diameter is ~2.2 degrees of arc. The dimensions of the well 12 in the preferred embodiment easily allow for a total sample volume in the well 8 of 3 μL. So that any possible wetting of the well wall and top surface of the platform in the vicinity of the top rim is mitigated, a total sample volume of 2 μL or less can routinely be used in each well of the preferred embodiment.

Figure 2B:
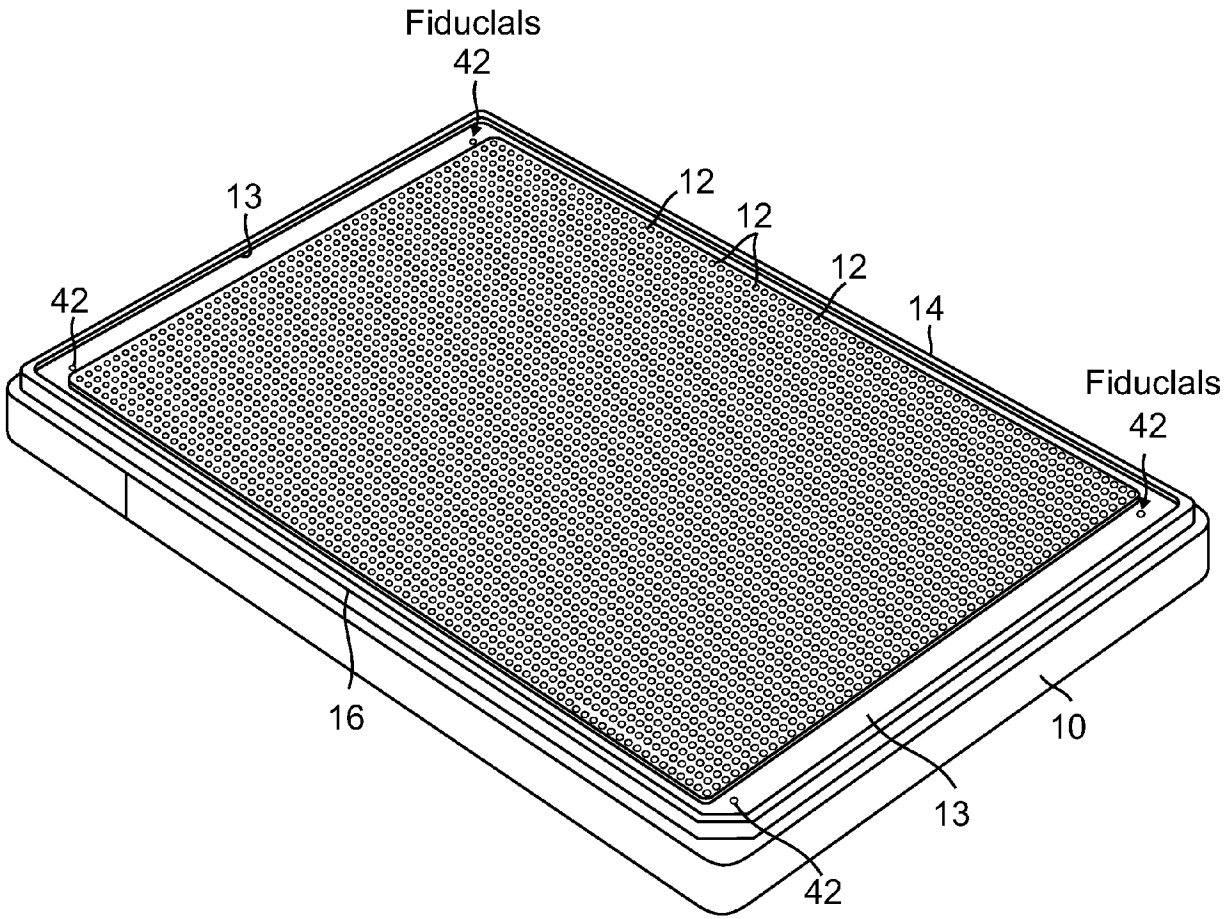
FIG. 2*b* schematically illustrates a perspective view of a 3456 well plate in accordance with a preferred embodiment.

A perspective view of a 3456 well plate 10 in accordance with a preferred embodiment is schematically illustrated at FIG. 2*b*. The plate 10 of FIG. 2*b* includes 48 rows of wells 12 in the short dimension and 72 rows of wells 12 in the long dimension. The long dimension of the plate 10 of the preferred embodiment from edge to edge is about 127.76 mm, and has peripheral portions 13 not including wells on each of the short ends of the plate 10, as well as peripheral portions 14 and 16 also not including wells at the long ends of the plate 10. The short dimension of the plate 10 from edge to edge is about 85.47 mm. Each well 12 is about one millimeter in diameter, although the diameter is preferably somewhat larger at the top than at the bottom (see above), and schematically illustrated not necessarily to scale at FIG. 3*a*. The high-density plate 10 illustrated at FIG. 2*b* is advantageously designed to function both as a storage plate and as an assay plate.

Figure 2C:
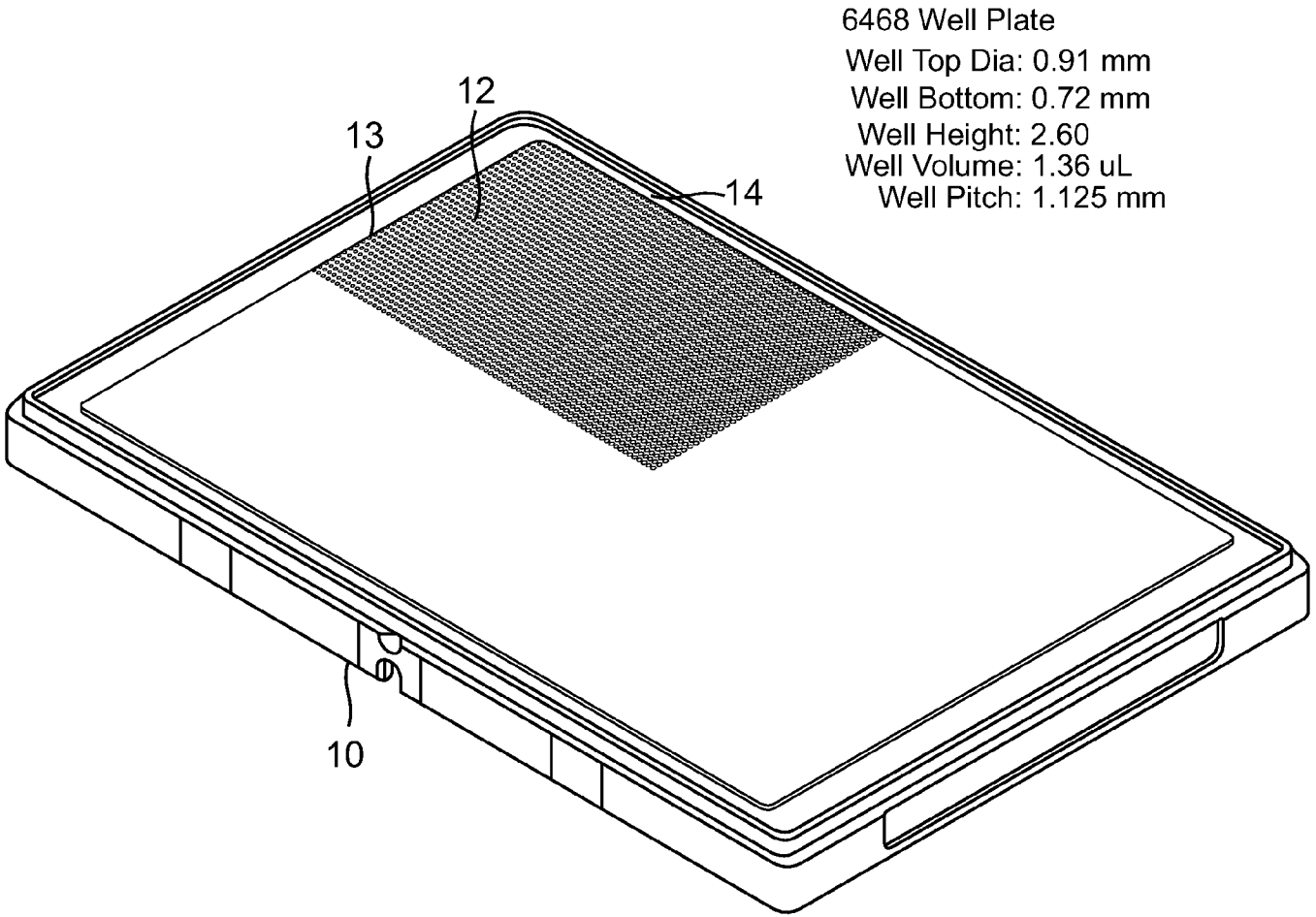
FIGS. 2*c*-2*d* schematically illustrates a perspective view of a 6468 well plate in accordance with a preferred embodiment.
Figure 2D:
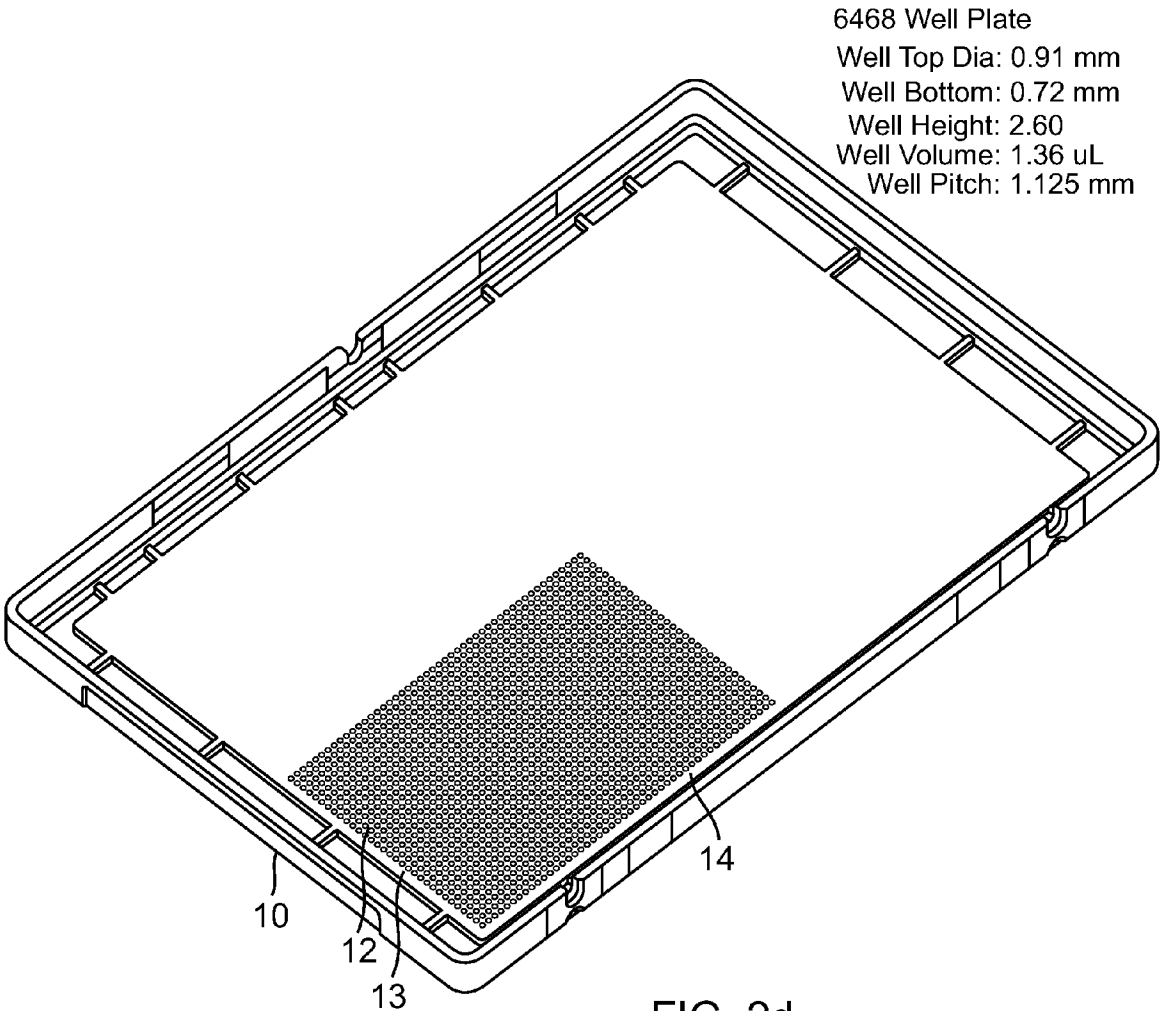

A perspective view of a 6464 well plate 10 in accordance with a preferred embodiment is schematically illustrated at FIGS. 2*c*-2*d*. Only a portion of the wells is illustrated in the figures. The plate 10 of FIGS. 2*c*-2*d* includes 6144 active wells having 64 rows of wells 12 in the short dimension and 96 rows of wells 12 in the long dimension. Surrounding these are 324 evaporation wells 22. The long dimension of the plate 10 of the preferred embodiment from edge to edge is about 127.76 mm, and has peripheral portions 13 as well as peripheral portions 14 at the long ends of the plate 10. The short dimension of the plate 10 from edge to edge is about 85.47 mm. Each well 12 is less than one millimeter in diameter, although the diameter is preferably somewhat larger at the top (0.91 mm) than at the bottom (0.72), and schematically illustrated not necessarily to scale at FIG. 3*a*. The well volume is 1.36 and the well pitch is 1.125 mm. The high-density plate 10 illustrated at FIGS. 2*c*-2*d* is advantageously designed to function both as a storage plate and as an assay plate.

Materials and Manufacture

Figure 3A:
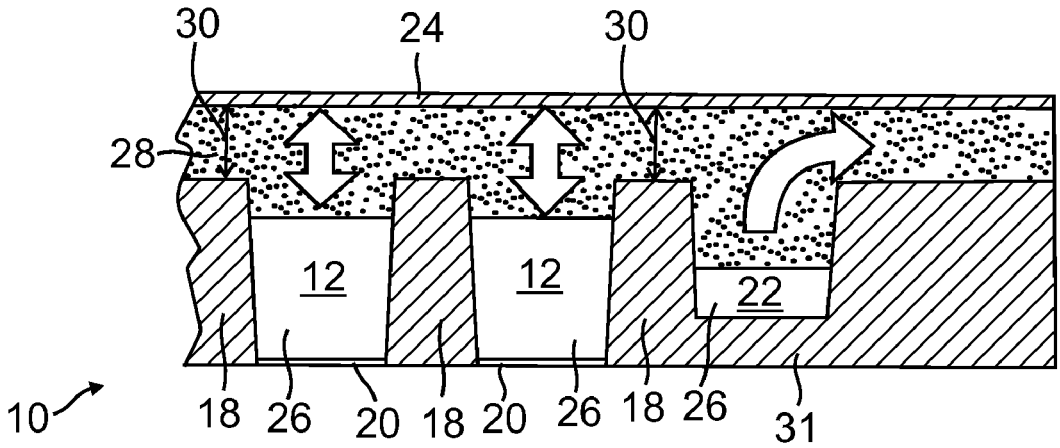
FIG. 3*a* schematically illustrates a cross-sectional side view of two active wells and a dummy well of a multiple-well plate with a lid in accordance with a preferred embodiment.

The plate 10 is preferably injection molded of cyclo-olefin polymer (COP), or as described above, alternatively cyclo-olefin copolymer (COC). Referring to FIG. 3*a*, the body 18 is preferably black with a clear file 20 fixed to the bottom. The clear file 20 is pre-extruded and placed into the mold before the material for the black body 18 is injected. The mold is built of stainless steel and uses four injection gates placed at the outer walls of the plate 10. It has polished core pins to create the wells 12 and a stripper plate to remove the part from the core pins after it solidifies. The black body 18 is made preferably of Zeonex or Zeonor resins, preferably Zeonex 480, 480R, 690R, or Zeonor 1420R and the clear file 20 is preferably Zeonor 750 or Zeonex 480, 480R, 690 or 690R (Zeonor and Zeonex resins are available from Zeon Corporation, Tokyo, Japan). These formulations of resin have molding properties and film extrusion properties that are desirable. Other grades of Zeonor and Zeonex resin also exhibit desirable properties. Both materials have very low auto-fluorescence, which is important because of the nature of the work performed in plates. Also, the material used for the clear film 20, Zeonor 750, is optically transparent from 230 to 350 nm. COP is biocompatible and resistant to dimethyl sulfoxide (DMSO), the organic solvent most commonly used to dissolve and store small-molecule drug candidates. As mentioned, many polymers (namely polystyrene) used to make optical plates are not DMSO-resistant, making them undesirable for use as chemical storage plates. The DMSO-resistance and the optical qualities of COP are unique features that facilitate the dual use of the plate 10 of the preferred embodiment: compound storage and biological assays. Another manufacturer, Hoescht Corporation produces the TOPAS product line of cyclo-olefin copolymer and polymer.

It is preferred for the material used to be resistant to the solvent used, and thus if the solvent is other than DMSO, then the material used is preferably resistant to that particular solvent. The material for the bottoms 20 of the active wells 12, or the clear file 20, is optically transparent from 230 to 350 nm or other wavelengths that may be used in a process involving the plate 10 and the wells 12, notwithstanding which solvent it is designed to be resistant to. Similarly, the body 18 is preferably opaque and has low auto-fluorescence at wavelengths of interest, e.g., less than 5%, or less than 4%, or substantially 3% or less, permits the plate 10 to remain substantially flat at elevated temperatures such as up to 110° C., 120° C., 125° or preferably 127° C. or more, or other assay temperature for the plate 10, and resistant to the solvent used.

The material choice for the plate 10 preferably permits the plate 10 to remain substantially flat at these elevated temperatures. With such material forming the plate 10, assays may be performed at these elevated temperatures. A plate 10 is "substantially flat" within this context when the plate 10 has a sufficient degree of flatness that an assay may be performed without individual sensors (not shown) associated with the wells 12 being misaligned from the wells 12, e.g., to the extent that the assay would produce intolerable sensing error. Such misalignment may be an angular offset of an axis through the center of the well 12 to a normal to the sensor, a displacement of the center of the sensor to an axial extension of the well 12, a lateral or longitudinal displacement of the bottom of the well from a plane of the sensor or in any other direction away from optimum, etc.

Geometry

The shape of the preferred plate 10 is such that the tops of the wells 12 are approximately flush with the top of the plate 10. This permits liquid in a source well to be placed very close to the target while dispensing acoustically. The flat bottom of this plate 10 is also advantageous for acoustic dispensing because the acoustic actuator transmits energy via a fountain of coupling fluid whose meniscus is placed in contact with the bottom of the storage plate 10. As the dispenser moves from well 12 to well 12, the coupling fluid is dragged along the bottom of the plate 10 maintaining contact via surface tension. Any irregularities in the bottom surface 20 of the plate 12 would disrupt the coupling and make dispensing difficult.

Figure 3B:
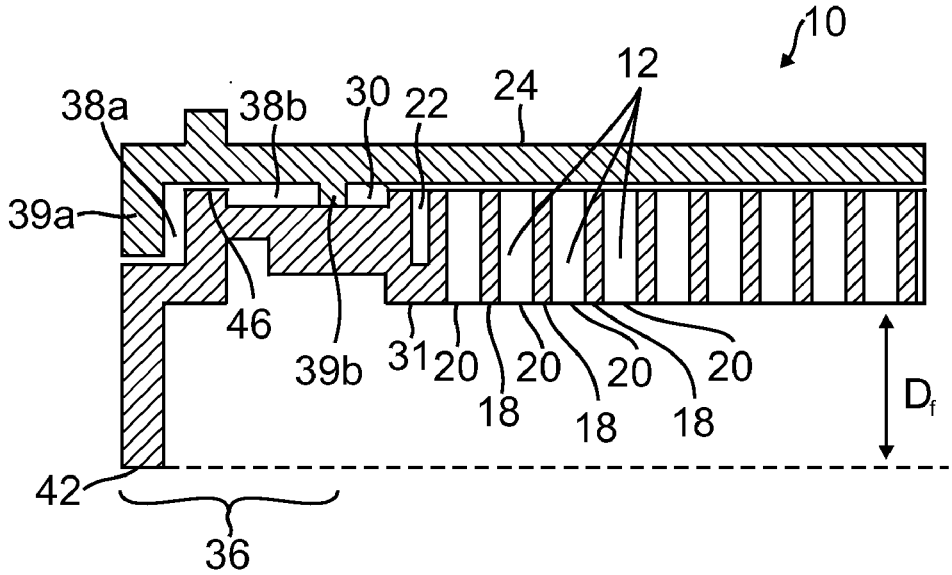
FIG. 3*b* schematically illustrates a cross-sectional side view of several active wells, a dummy well and additional structure of a multiple-well plate with a lid in accordance with a preferred embodiment.

With reference now to FIG. 3*b*, which is a side view of a cross-section of a row or column of wells 12, the well bottom 20 is created with a sheet film of material of the desired thinness and optical properties that is applied to the bottom side of the platform in which the array of wells 12 is disposed. In the preferred embodiment, both the honeycomb plate and the bottom sheet film are advantageously constructed of the same material, cyclo-olefin copolymer. Sealing of the film sheet 20 to the honeycomb surface around each well 12 is accomplished by heat, radio-frequency irradiation, or ultrasonic welding, or other means known to those skilled in the art (see also, U.S. Pat. No. 6,232,114, to Coassin et al, 2001, incorporated by reference above), and both the honeycomb and the sheet exhibit the same degree of shrinkage. This keeps the sheet material that spans each well 12 at the bottom 18 of the honeycomb flat. The thickness of the bottom sheet may be selected by balancing increasing structural rigidity to maintain bottom flatness by increasing the thickness, with decreasing intrinsic fluorescence emanating from the bottom material during spectrometric measurement by decreasing the thickness. In the preferred embodiment, transparent bottom sheets used are between 50 and 300 μm in thickness.

The array of wells 12 is shown supported by a flange 36 at FIGS. 2*b* and 3*b*. The flange 36 surrounds the outermost rows and columns of wells 12 and provides structural support by extending the solid material comprising the honeycomb beyond the well array. The purpose of the flange 36 is to support the well array so that the well array is oriented horizontally when it is positioned for different functional purposes such as aspirating chemical samples, adding liquid reagent, or performing fluorescence measurements. In this extended area that surrounds the outermost well, between the well array and the top edge of the plate 10, a variety of appurtenances and modifications can be made that improve the functionality of the platform. For example, small indentations 38*a*, 38*b* can be made to accept protuberances 39*a*, 39*b*, respectively, from a lid 24 that covers the top surface of the wells to prevent contamination or evaporation (see FIG. 3*b*). In addition, various markings can be made to provide a topographical mapping of each well to a coordinate system for purposes of well identification (see FIG. 4*b* and further description below). On the side of the flange 36, various indentations can be made to enable the platform to be oriented and firmly locked into a mechanical fixture for the purposes of access by various assay instrumentation. The flange 36 provides the means by which the bottom surface of the well bottom sheet 20 is located at a fixed reference distance $D_f$ above the bottom 42 of the flange 36. The flange 36 also serves to fix the overall outer planar dimensions of the plate 10 (the footprint) so that it is consistent with the proposed microplate standard, which is a length of 127.7±0.25 mm and a width of 85.5±0.25 mm. In the preferred embodiment, the flange 36 maintains the bottom sheet comprising the well bottoms 20 at a height $D_f$ of around 8 mm above the bottom 42 of the flange 36.

Evaporation Control

FIGS. 3*a* and 3*b* schematically illustrate cross-sectional side views of two or more active wells 12 and a dummy well 22, each being within a particular row or column, and in respectively adjacent columns or rows, of a multiple-well plate 10 also having a lid 24 in accordance with preferred embodiments. There is a small gap 30 or space 30 between the lid 24 and the tops of the wells 12, as illustrated, which may be advantageously small, e.g., ⅛ or even 1/16 of an inch or less. Referring specifically to FIG. 3*a*, as liquid 26 in the wells 12 evaporates and becomes vapor 28, the partial pressure of that vapor 28 increases in the space 30 above the wells 12. This occurs until the system reaches equilibrium, at which point the liquid 26 will cease to evaporate. The situation is different at the edges of the plate 10. Here, the vapor being created diffuses away from the evaporation control well 22 or dummy well 22 and into the outside environment. The system does not reach equilibrium, and instead, liquid 26 continues to evaporate and vapor 28 continues to diffuse away indefinitely. Small peripheral wells experience this phenomenon more drastically than large wells, because their average distance from the edge is significantly shorter. Because of this, the system of the preferred embodiment includes a ring of "dummy" wells 22 surrounding the matrix of "active", "assay" or "actual" wells 12. The above-described enhanced evaporation from these "edge", "evaporation control" or "dummy" wells 22 does not affect assay results because no assay data from these wells 22 is used in assay results in accordance with a preferred embodiment.

Figure 4A:
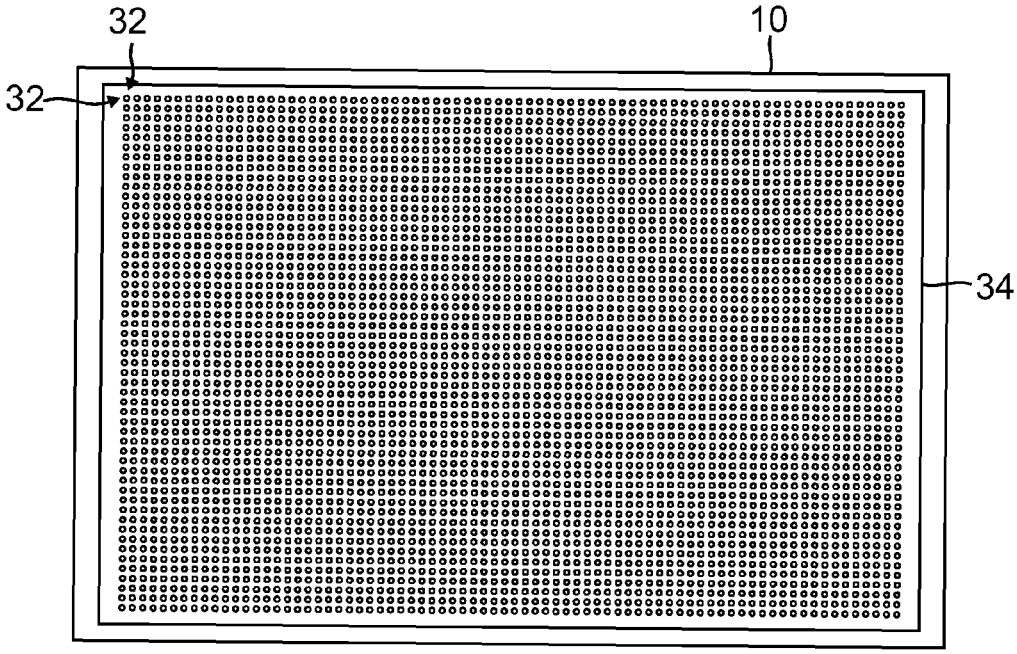
FIG. 4*a* schematically illustrates in top view locations of dummy wells in a multiple-well plate in accordance with a preferred embodiment.

FIG. 4*a* schematically illustrates locations of dummy well rows 32 in a multiple-well plate 10 in accordance with a preferred embodiment. These dummy wells 22 are preferably similar, or alternatively identical, in size and shape to the actual wells 12 and are placed such that they extend the matrix of actual wells 12 by two in each direction. The dummy wells 22 preferably have a shallower depth than the active wells 12 due to a thicker, opaque bottom layer 31 (see FIG. 3*a*) than the bottom layer 20 of the active wells 12. The dummy wells 22 act to increase the average distance from the outermost actual wells 12 to the edge, creating a buffer against evaporation. The liquid in the dummy wells 22 serves to replenish the supply of vapor 28 in the space 30 immediately above the wells 12, or serve as a source of vapor 28 that diffuses to the outside environment thereby controlling the partial pressure gradient seen by the vapor in the space above the active wells 12. The placement of the dummy wells 22 at the periphery of the matrix of active wells 12 reduces the exposure of the active wells 12 to a partial pressure gradient that would encourage vapor 28 to diffuse away and more liquid 26 to evaporate.

Aurora Biosciences Corporation's NanoWell Assay Plate has peripheral troughs designed to be filled with liquid to mitigate evaporation from the edge wells. However, these troughs are difficult to fill, especially with automated equipment, and liquid in them tends to spill out easily. Because the dummy wells 22 of the preferred plate 10 are preferably the same size, shape, and spacing as the actual wells 12, the dummy wells 22 can be filled by the same equipment that fills the actual wells 10, and the liquid 26 will be held in place by surface tension. The preferred plate 10 also has a trough 34

(see also element 38*b* of FIG. 3*b*) surrounding the wells 12. The trough 34 is used in conjunction with a protrusion (see element 39*b* of FIG. 3*b*) on the lid 24 to create a labyrinth to increase the distance across which vapor 28 has to diffuse. This makes the partial pressure gradient less steep, further discouraging evaporation from the wells 12.

Figure 4B:
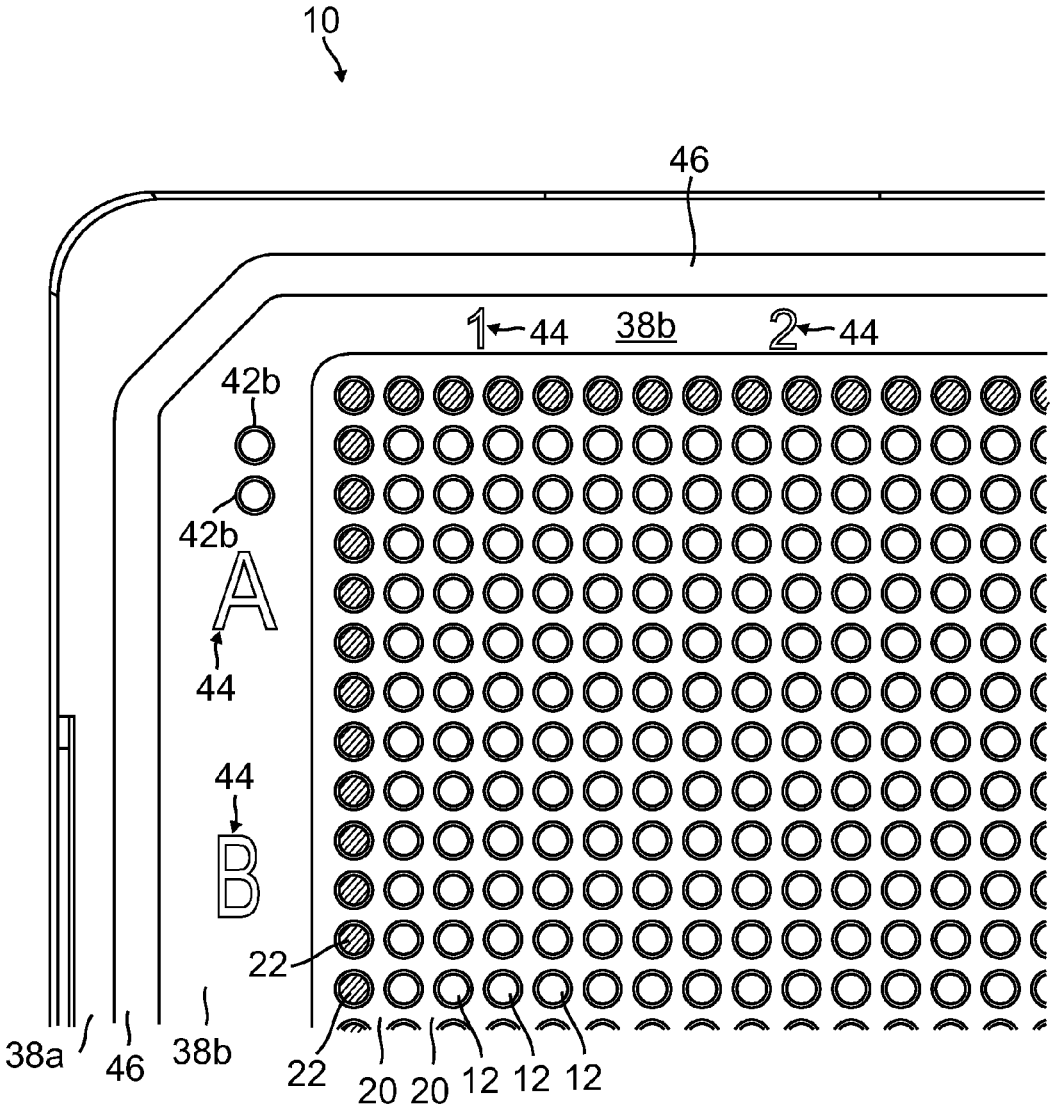
FIG. 4*b* schematically illustrates in an enlarged top view locations of dummy wells and additional structure in a multiple-well plate in accordance with a preferred embodiment.

In FIG. 4*b*, the crosshatched circles depict rows and columns of wells 22 at the outermost edges of the well array. These wells 22 are formed so that they do not completely penetrate the slab in which the array of assay sample or chemical storage wells is formed. Instead, they extend only a fraction (e.g., 0.5) of the thickness of the honeycomb. Moreover, they do not contain samples, but serve as repositories for whichever solvent is present in the sample wells 12, which are those wells 12 that completely penetrate the honeycomb material. These wells 22 serve as evaporation control wells 22 when the platform is covered with a lid 24 that seats utilizing the accepting indentations 38*a*, 38*b* provided in the outer part of the flange 36. For example, when the platform is used as a chemical storage platform for chemical compounds dissolved in DMSO, the wells 22 are filled with DMSO to provide a bulk source for a vapor head of DMSO in each well 22 to mitigate loss of volume in the wells 12 being used for storage. Conversely, when assays based on aqueous media are contained in the sample wells 12, the evaporation control wells 22 are filled with water or aqueous media to provide a vapor head of water for the assay sample-containing wells 12. The evaporation control wells 22 provide a bulk reservoir of solvent that enables the vapor phase above the upper surface of the liquid in each well 22 to attain thermodynamic equilibrium without evaporation of the liquid in the sample wells 12. In the preferred embodiment, the protuberant rim (39*a*, 39*b*, see FIG. 3*b*) of the lid (24, see FIG. 3*b*) that fits in the indentation 38*a*, 38*b* in the outer region of the platform completely surrounds the well array and completely closes the wells 12, 22. The evaporation control wells 22 provide the excess bulk liquid phase needed to fill the resulting closed head space with vapor in the absence of evaporation of liquid in the sample wells 12.

To accommodate the evaporation control wells 22 in the array of sample wells, the evaporation control wells 22 may be situated as an extra row and column along the outermost sample wells 12 at each side in the sample array. Thus, in the preferred embodiment, which is an array of 48×72 sample wells 12, the addition of an evaporation control well 22 at the two ends of each row and each column and at the four corners of the well array results in a total array size of 50×74 wells (12+22). FIG. 9 shows the total number of wells for a plate including evaporation wells. The calculation for the number of wells is two times the wells in the row plus two times the wells in the column plus four (the corners).

Special Features for Alignment

Figure 6A:
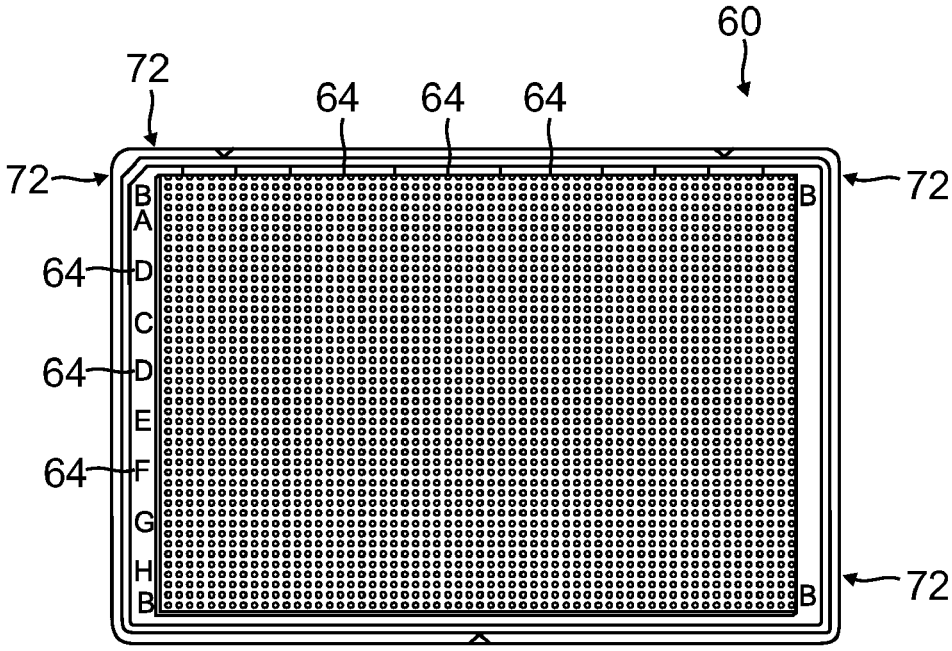
Figure 6A:
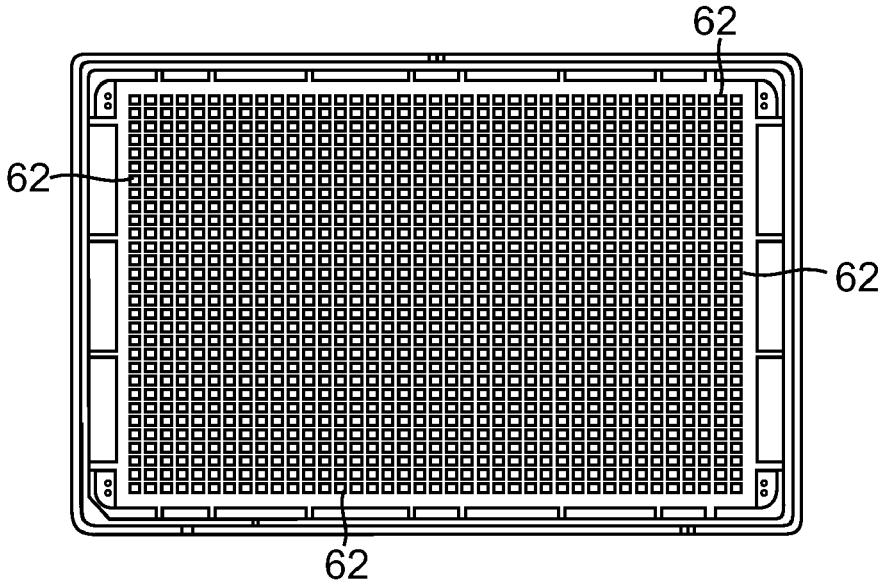
Figure 6C:
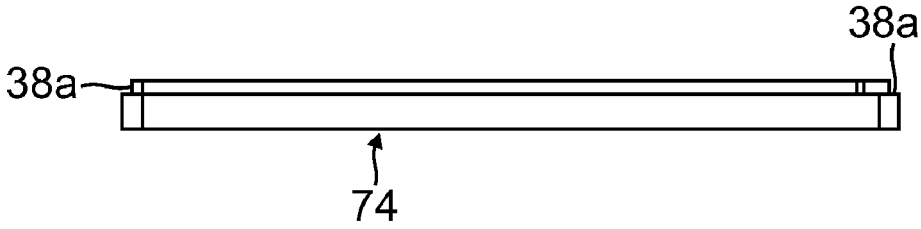
Figure 6D:
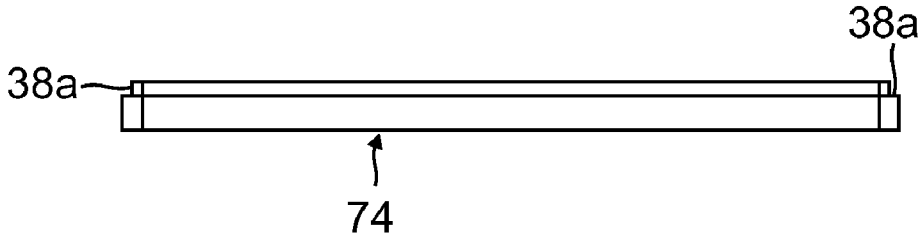
Figure 6E:
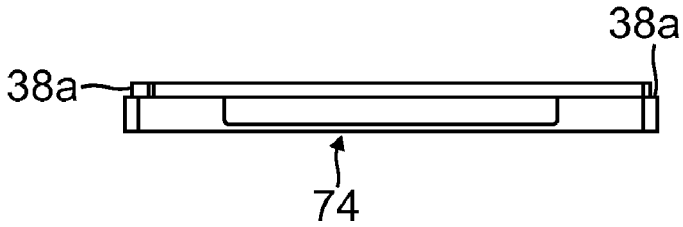
Figure 6F:
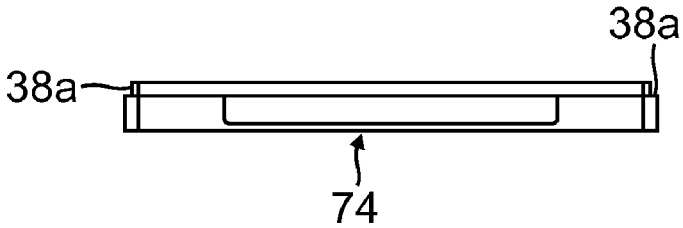

As mentioned above, small wells 12 generally need to be aligned more precisely with respect to the instruments that access them than larger wells, all else being equal. Referring to FIG. 2*b* (see also FIGS. 4*b*, 6*a* and 6*b*), four optical fiducial 42 are located two at each long dimension peripheral portion 13, and preferably near corners of the plate 10. Each is preferably a reflective convex hemisphere, spherical section, curved surface, or otherwise configured to reflect a particular alignment light back to a particular alignment detector with optimized alignment efficiency balancing area of coverage of the detector versus density of signal intensity, and preferably molded into the part with a polished surface. A ring light mounted on a camera can illuminate the hemisphere such that the image produced is a very small (10-20 microns), high-contrast reflection. This is useful because every injection molded part is slightly different, so very precise alignment can be more greatly ensured by registering the geometry of each plate 10 individually.

With reference again to FIG. 4*b*, which is a top view of a preferred platform, several features of the outermost extension of the plate material surrounding the wells 12 is shown, which are incorporated in the preferred embodiment. These include a continuous indentation 38*b* surrounding the well array for accepting a lid (see element 24 of FIGS. 3*a* and 3*b*), the array of evaporation control wells 22 or dummy wells 22, and markings 44 for a well coordinate system.

The indentation 38*b* on the top surface is preferably a rectangular perimeter that completely surrounds the well array and extends from the outer well array to the edge of the top surface of the plate 10. In the preferred embodiment, this edge 46 (see also element 46 of FIG. 3*b*) is raised to the same height as the top surface of the well array. The depth of the indentation 38*b* (see also indentation 38*a* of FIG. 3*b*) is matched to the height of a protuberant rectangular perimeter (see elements 39*a*, 39*b* of FIG. 3*b*) on the bottom surface of a flat lid that completely covers the well array. When the lid is placed on top of the plate such that the raised protuberance (39*b*, FIG. 3*b*) fits completely in the indentation 38*b* surrounding the well array, the bottom surface of the lid is brought to a very small distance above the top surface of the plate creating a closed volume above the array of wells 12. This serves to prevent loss of the liquid contents of the wells 12 through evaporation and to prevent contamination of the wells by dust or other environmental debris.

Figure 5:
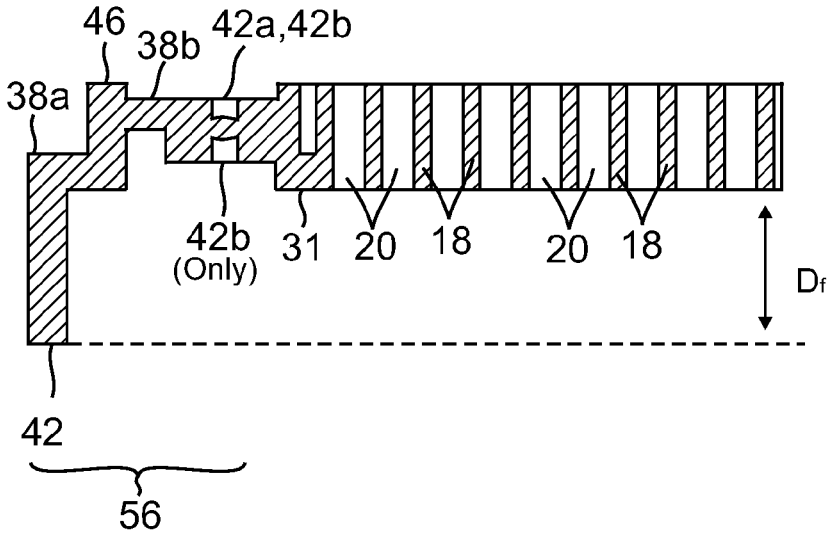
FIG. 5 schematically illustrates a cross-sectional side view of several active wells, a dummy well and additional structure of a multiple-well plate in accordance with another embodiment.

With reference to FIGS. 4*b* and 5, a plate 10 including a flange 56 (referenced at FIG. 5 and not FIG. 4*b*) according to an alternative embodiment from the embodiment including the flange 36 of FIG. 3*b* is shown, which aids in alignment of the plate 10 by automated instrumentation. Referring first to FIG. 4*b*, in the outer area (i.e., where the flange 56 of FIG. 5 meets the well array) is a pair of circular indentations 42*a* and 42*b*. In one indentation 42*b*, the bottom portion is raised as a spherical, cross-sectional circular, or otherwise selectively contoured protuberance, as shown in the side view of FIG. 5. In the other indentation 42*a*, the protuberance is absent. The centers of the two indentations 42*a*, 42*b* are preferably aligned along a defined axis of the well array, such as the width axis defined the centers of the wells 12 comprising a row. A pair of indentations 42*a*, 42*b* is present at near of the four corners of the plate 10. In addition, the set of indentation pairs is replicated on the bottom surface of the plate flange. These indentations provide an asymmetric feature that can be illuminated and brought into focus as a pair of spots of opposite contrast. This image can be recognized by automated image processing of top and bottom views of the plate 10 for top and bottom registration and alignment of the plate 10 with robotic instrumentation.

Materials

In a preferred embodiment, the multi-well platform is manufactured entirely from Zeonor 750 COC resin or Zeonor 1420R resin or Zeonex 480 COP resin or Zeonex 690R (Zeon Chemicals, Tokyo, Japan). Alternatively preferred embodiments include variations of cyclo-olefin copolymer (COC) and cyclo-olefin polymer (COP) as may be understood by those skilled in the art. Zeonor 750 or Zeonor 1420R resin or Zeonex 480 COP resin or Zeonex 690R offers numerous features required for a material to meet the diverse requirements of the multifunctional multi-well platform. These features include low intrinsic fluorescence and high transmittance to ensure minimal interference with spectrometric assays, chemical inertness to ensure solvent compatibility, and low cytotoxicity to ensure the viability of biological assays. Coassin et al (2001, U.S. Pat. No. 6,232,114, incorporated by reference above) teach numerous manufacturing methods for the copolymerization of COC resins and molding multi-well plates from those resins. These methods are incorporated by reference in their entirety. Several advantages of the preferred Zeonor 750R resin over the COC resins described that patent are catalyst-free polymerization, colorization methods, and decreased absorption of short ultraviolet wavelengths. Catalyst-free polymerization is achieved by the use of thermally activated moieties functionalized to the cycloalkane and polyethylene monomers in the COC polymerization reaction (Technical Report "Zeonex and Zeonor Technology Applications", Zeon Corporation, 2002, which is incorporated by reference in its entirety) This results in extremely low levels of residual catalyst in the resin, such as heavy metals, that could leach into an assay sample and be toxic to cells or lead to spurious biological activity.

In a preferred embodiment, the material comprising the well walls, the inter-well spacing, and the surrounding flange 36,56 are opaque, to enable spectrometric measurements to be obtained individually from each well 12 without contamination by stray light emanating from the fluorescence originating in nearby wells 12. Zeonor 750 or Zeonor 1420R resin or Zeonex 480 resin or Zeonex 690R may be advantageously rendered opaque by the addition of fine carbon black particles, such as Omnicolor IM005, Reed Spectrum, Holden, Mass., to a weight percentage ranging from 0.5% to 15%. The resin may also be rendered opaque, in accordance with a preferred embodiment, with low surface reflectivity by brief exposure to air at temperatures exceeding 200° C. and then quenching with molecular nitrogen when the desired opacity is obtained. This does not need to involve the addition of inclusions of any carbon black particles to the resin that may decrease the density of the copolymer and render it more fragile. The opacity of the interstitial material between the wells improves the reliability of a spectrometric assay signal recorded from each well by decreasing the amount of stray fluorescence from adjacent wells that is able to reach the spectrometric detector.

In the preferred embodiment, the film sheet that forms the bottom of the sample wells is selected to provide the least amount of interaction with the spectrometric assay. Sources of interaction include absorption by the platform materials of wavelengths emitted by the sample as the signal as well as intrinsic fluorescence of the platform materials by illumination with light of the wavelengths employed in a fluorescence assay. Desirable properties include high light transmittance in the range of wavelengths that are recorded and low absorbance of short ultraviolet wavelengths. Absorption of short ultraviolet wavelengths by a material results in electronic excitation of its constituent molecules with the subsequent emission at longer wavelength. Therefore, short UV wavelength absorption provides an indication of the susceptibility of the intrinsic fluorescence or autofluorescence of the material. Zeonor 750 or Zeonex 480 exhibits an absorbance of 0.1 $mm^{-1}$ with illumination at a wavelength of 230 nm, and this absorbance decreases to 0.05 $mm^{-1}$ at 280 nm. As taught by U.S. Pat. No. 6,517,781 to Coassin et al., hereby incorporated by reference, COC resins exhibit autofluorescence characteristics most similar to those of quartz of all the different plastics tested as plate bottom materials. In addition, Zeonor 750 or Zeonex 480 exhibits relatively high transmittance in the UV waveband and continuing into the visible wavelengths where most fluorescence assays are performed. A one millimeter thick sheet of this resin has a transmittance reaching 40% at a wavelength of 220 nm which increases to 80% at 260 nm. Thus, Zeonor 750 or Zeonor 1420R resin or Zeonex 480 resin or Zeonex 690R is a forward continuation in the improvement of plastic resin materials suitable for multi-well platforms optimized for spectrometric assays. Some properties of Zeonor 750 that are relevant to the multi-Well platform described in this description of the preferred embodiments in comparison with some other plastic materials are summarized in Table 1.

| | Zeonor 750 | polystyrene | polyethylene |
|---|---|---|---|
| Change in 400 nm transmittance after steam sterilization (thickness = 3 mm) | Not detectable | Opaque after treatment (requires radiation sterilization) | Opaque before treatment |
| Moisture permeability ($gm\text{-}m^{-2}$ in 24 hr thickness = 0.3 mm) | 0.28 | 1.32 | 5.6 |
| Heat distortion temperature (° C.) | 127 | 110 | 75 |
| Contact angle of water drop (degrees of arc) | 94 | 80 | 55 |
| Mold shrinkage (%) | 0.6 | 0.5 | 1.8 |
| Fluorescence intensity at 450 nm with excitation at 350 nm (thickness = 50 μm) | 0.31 | 2.04 | Not applicable due to intrinsic opacity |
| DMSO resistance | Yes | No | Yes |
| Tensile modulus (MPa) | 2000 | 3300 | 1400 |
| Flexural modulus (MPa) | 1800 | 3000 | 1500 |

The table reveals that the material used in the preferred embodiment is suitable for both spectrometric assays in the range of visible wavelengths, storage of chemical compound concentrates in DMSO and other functions encountered in screening applications that use multi-well for plates. The low water vapor permeability is an advantage in that aqueous sample assays can be prepared and incubated for long periods such as days with minimal loss of volume due to leakage of emanating water vapor through the well walls. This loss is also attenuated by the presence of the evaporation control wells at the periphery of the matrix of sample wells. The high contact angle of water indicates that Zeonor 750 is hydrophobic relative to other plastics used for plates, such as polystyrene and polyethylene, so that the well wall does not interact with the contents of aqueous assay mixtures. The plate can be relatively easily sterilized with steam whereas other plastic materials undergo distortion and clouding that result in light transmittance changes. The relative mechanical strength of the COC is sufficient to enable it to withstand the forces encountered in routine plate handling. Thus, Zeonor 750 combines both mechanical strength and heat resistance with very high optical and spectrometric quality making it a superior choice for multi-well platform construction.

The multi-well plates of the present invention can include coatings or surface modifications to facilitate various applications of the plate as described herein and known or developed in the relevant art. Coatings can be introduced using any suitable method known in the art, including printing, spraying, radiant energy, ionization techniques or dipping. Surface modifications can also be introduced by appropriately derivatizing a polymer before or after the manufacture process and by including an appropriate derivatized polymer in the cycloolefin layer. The derivatized polymer can then be reacted with a chemical moiety that is used in an application of the plate. Prior to reaction with a chemical moiety, such polymer can then provide either covalent or non-covalent attachment sites on the cycloolefin. Such sites in or on the cycloolefin surface can be used to attach moieties, such as assay components (e.g., one member of a binding pair), chemical reaction components (e.g., solid synthesis components for amino acid or nucleic acid synthesis), and cell culture components (e.g., proteins that facilitate growth or adhesion). Examples of derivatized polymers include those described by U.S. Pat. No. 5,583,211 (Coassin et al.). Particularly preferred embodiments are based on polyethylene and polypropylene derivatives that can be included as cycloolefin copolymers.

The cycloolefin layer can also include a plurality of living cells. Such embodiments are useful for cell based assays described herein and for growing cells using culture methods. Plates of the invention can include a coating (e.g., polylysine) to enhance attachment of cells.

Uses for multi-well plates are known in the relevant arts and include diagnostic assays, chemical or biochemical binding assays, filtration assays, chemical synthesis sites, storage sites, and the like. Such uses can also be applied to the present invention. It will be recognized that some types of multi-well plates for spectroscopic measurements can often be used for other multi-well plate applications. Typically, a multi-well plate is used for detecting a signal from a sample. Different types of signal measurements are discussed herein.

The present invention also provides a system for spectroscopic measurements. The system comprises reagents for 1) an assay, 2) a device, comprising a layer with low fluorescence and high transmittance, comprising a cycloolefin copolymer, and a multi-well plate to hold the layer. The system can further comprise a detector. In this context, a reagent for an assay includes any reagent useful to perform biochemical or biological in vitro or in vivo testing procedures, such as, for example, buffers, proteins, carbohydrates, lipids, nucleic acids (including SNP analyses), active fragments thereof, organic solvents such as DMSO, chemicals, analytes, therapeutics, compositions, cells, antibodies, ligands, and the like. In this context, an active fragment is a portion of a reagent that has substantially the activity of the parent reagent. The choice of a reagent depends on the type of assay to be performed. For example, an immunoassay would include an immuno-reagent, such as an antibody, or an active fragment thereof.

The present invention plates and methods are useful for detection of SNPs. Many methods are available for detecting specific alleles at human polymorphic loci. The preferred method for detecting a specific polymorphic allele will depend, in part, upon the molecular nature of the polymorphism. For example, the various allelic forms of the polymorphic locus may differ by a single base-pair of the DNA. Such single nucleotide polymorphisms (or SNPs) are major contributors to genetic variation, comprising some 80% of all known polymorphisms, and their density in the human genome is estimated to be on average 1 per 1,000 base pairs. SNPs are most frequently biallelic-occurring in only two different forms (although up to four different forms of an SNP, corresponding to the four different nucleotide bases occurring in DNA, are theoretically possible). Nevertheless, SNPs are mutationally more stable than other polymorphisms, making them suitable for association studies in which linkage disequilibriumn between markers and an unknown variant is used to map disease-causing mutations. In addition, because SNPs typically have only two alleles, they can be genotyped by a simple plus/minus assay rather than a length measurement, making them more amenable to automation.

The present invention includes systems and methods that utilize automated and integratable workstations for detecting the presence of an analyte and identifying modulators or chemicals having useful activity. The present invention is also directed to chemical entities and information (e.g., modulators or chemical or biological activities of chemicals) generated or discovered by operation of workstations of the present invention.

The present invention includes automated workstations that are programmably controlled to minimize processing times at each workstation and that can be integrated to minimize the processing time of the liquid samples from the start to finish of the process. Typically, a system of the present invention would include: A) a storage and retrieval module comprising storage locations for storing a plurality of chemicals in solution in addressable chemical wells, a chemical well retriever and having programmable selection and retrieval of the addressable chemical wells and having a storage capacity for at least 100,000 the addressable wells, B) a sample distribution module comprising a liquid handler to aspirate or dispense solutions from selected the addressable chemical wells, the chemical distribution module having programmable selection of, and aspiration from, the selected addressable chemical wells and programmable dispensation into selected addressable sample wells (including dispensation into arrays of addressable wells with different densities of addressable wells per centimeter squared), C) a sample transporter to transport the selected addressable chemical wells to the sample distribution module and optionally having programmable control of transport of the selected addressable chemical wells (including adaptive routing and parallel processing), D) a reaction module comprising either a reagent dispenser to dispense reagents into the selected addressable sample wells or a fluorescent detector to detect chemical reactions in the selected addressable sample wells, and a data processing and integration module.

The present invention can be used with systems and methods that utilize automated and integratable workstations for identifying modulators, pathways, chemicals having useful activity and other methods described herein. Such systems are described generally in the art (see, U.S. Pat. No. 4,000,976 to Kramer et al. (issued Jan. 4, 1977), U.S. Pat. No. 5,104,621 to Pfost et al. (issued Apr. 14, 1992), U.S. Pat. No. 5,125,748 to Bjornson et al. (issued Jun. 30, 1992), U.S. Pat. No. 5,139,744 to Kowalski (issued Aug. 18, 1992), U.S. Pat. No. 5,206,568 Bjornson et al. (issued Apr. 27, 1993), U.S. Pat. No. 5,350,564 to Mazza et al. (Sep. 27, 1994), U.S. Pat. No. 5,589,351 to Harootunian (issued Dec. 31, 1996), and PCT Application Nos: WO 93/20612 to Baxter Deutschland GMBH (published Oct. 14, 1993), WO 96/05488 to McNeil et al. (published Feb. 22, 1996) and WO 93/13423 to Akong et al. (published Jul. 8, 1993).

The storage and retrieval module, the sample distribution module, and the reaction module are integrated and programmably controlled by the data processing and integration module. The storage and retrieval module, the sample distribution module, the sample transporter, the reaction module and the data processing and integration module are operably linked to facilitate rapid processing of the addressable sample wells. Typically, devices of the invention can process at least 100,000 addressable wells in 24 hours. This type of system is described in U.S. Ser. No. 08/858,016 by Stylli et al., filed May 16, 1997, entitled "Systems and method for rapidly identifying useful chemicals in liquid samples", which is incorporated herein by reference.

If desired, each separate module is integrated and programmably controlled to facilitate the rapid processing of liquid samples, as well as being operably linked to facilitate the rapid processing of liquid samples.

In one embodiment the invention provides for a reaction module that is a fluorescence detector to monitor fluorescence. The fluorescence detector is integrated to other workstations with the data processing and integration module and operably linked with the sample transporter. Preferably, the fluorescence detector is of the type described herein and can be used for epi-fluorescence. Other fluorescence detectors that are compatible with the data processing and integration module and the sample transporter, if operable linkage to the sample transporter is desired, can be used as known in the art or developed in the future. For some embodiments of the invention, particularly for plates with 96, 192, 384 and 864 wells per plate, detectors are available for integration into the system. Such detectors are described in U.S. Pat. No. 5,589,351 (Harootunian), U.S. Pat. No. 5,355,215 (Schroeder), and PCT patent application WO 93/13423 (Akong). Each well of a multi-well platform can be "read" sequentially. Alternatively, a portion of, or the entire plate, can be "read" simultaneously using an imager, such as a Molecular Dynamics Fluor-Imager 595 (Sunnyvale, Calif.).

Fluorescence Measurements

It is recognized that different types of fluorescent monitoring systems can be used to practice the invention with fluorescent probes, such as fluorescent dyes or substrates. Preferably, systems dedicated to high throughput screening, e.g., 96-well or greater microtiter plates, are used. Methods of performing assays on fluorescent materials are well known in the art and are described in, e.g., Lakowicz, J. R., Principles of Fluorescence Spectroscopy, New York: Plenum Press (1983); Herman, B., Resonance Energy Transfer Microscopy, in: Fluorescence Microscopy of Living Cells in Culture, Part B, Methods in Cell Biology, vol. 30, ed. Taylor, D. L. & Wang, Y.-L., San Diego: Academic Press (1989), pp. 219-243; Turro, N. J., Modern Molecular Photochemistry, Menlo Park: Benjamin/Cummings Publishing Col, Inc. (1978), pp. 296-361 and the Molecular Probes Catalog (1997), OR, USA.

Fluorescence in a sample can be measured using a detector described herein or known in the art for multi-well platforms. In general, excitation radiation from an excitation source having a first wavelength, passes through excitation optics. The excitation optics causes the excitation radiation to excite the sample. In response, fluorescent probes in the sample emit radiation that has a wavelength that is different from the excitation wavelength. Collection optics then collect the emission from the sample. The device can include a temperature controller to maintain the sample at a specific temperature while it is being scanned. According to one embodiment, a multi-axis axis translation stage (e.g., a dedicated X,Y positioner) moves a multi-well platform holding a plurality of samples in order to position different wells to be exposed. The multi-axis translation stage, temperature controller, auto-focusing feature, and electronics associated with imaging and data collection can be managed by an appropriately programmed digital computer. The computer also can transform the data collected during the assay into another format for presentation.

Preferably, FRET (fluorescence resonance energy transfer) is used as a way of monitoring probes in a sample (cellular or biochemical). The degree of FRET can be determined by any spectral or fluorescence lifetime characteristic of the excited construct, for example, by determining the intensity of the fluorescent signal from the donor, the intensity of fluorescent signal from the acceptor, the ratio of the fluorescence amplitudes near the acceptor's emission maxima to the fluorescence amplitudes near the donor's emission maximum, or the excited state lifetime of the donor. For example, cleavage of the linker increases the intensity of fluorescence from the donor, decreases the intensity of fluorescence from the acceptor, decreases the ratio of fluorescence amplitudes from the acceptor to that from the donor, and increases the excited state lifetime of the donor.

Preferably, changes in signal are determined as the ratio of fluorescence at two different emission wavelengths, a process referred to as "ratioing." Differences in the absolute amount of probe (or substrate), cells, excitation intensity, and turbidity or other background absorbances between addressable wells can affect the fluorescence signal. Therefore, the ratio of the two emission intensities is a more robust and preferred measure of activity than emission intensity alone.

A ratiometric fluorescent probe system can be used with the invention. For instance the reporter system described in PCT publication WO96/30540 (Tsien and Zlokarnik) has significant advantages over existing reporters for gene integration analysis, as it allows sensitive detection and isolation of both expressing and non-expressing single living cells. This assay system uses a non-toxic, non-polar fluorescent substrate that is easily loaded and then trapped intracellularly. Cleavage of the fluorescent substrate by beta-lactamase yields a fluorescent emission shift as substrate is converted to product. Because the beta.-lactamase reporter readout is ratiometric, it is unique among reporter gene assays in that it controls variables such as the amount of substrate loaded into individual cells. The stable, easily detected, intracellular readout simplifies assay procedures by eliminating the need for washing steps, which facilitates screening with cells using the invention.

Methods for Detecting the Presence an Analyte in a Sample

A method of the present invention uses targets for detecting the presence of an analyte, such as chemicals that are useful in modulating the activity of a target, in a sample. Typically, as discussed below targets can be proteins such as cell surface proteins or enzymes. A biological process or a target can be assayed in either biochemical assays (targets free of cells), or cell based assays (targets associated with a cell). This method can also be used to identify a modulator of a biological process or target in a sample. This method detects the presence of an analyte in a sample contained in a multi-well platform of the present invention by detecting light emitted from the sample. The method comprises the steps of: exciting at least one sample with radiation of a first wavelength, wherein at least one sample suspected of containing an analyte is placed into at least one well of a multi-well platform of the present invention, which can contain a biological process or target. The sample and biological process or target can be contacted within the well, or outside of the well and later placed within the well. The emission of radiation of a second wavelength emitted from the sample is measured, wherein the amount of radiation of a second wavelength measured indicates the presence or absence of the analyte in the sample.

Targets can be cells, which may be loaded with ion or voltage sensitive dyes to report receptor or ion channel activity, such as calcium channels or N-methyl-D-aspartate (NMDA) receptors, GABA receptors, kainate/AMPA receptors, nicotinic acetylcholine receptors, sodium channels, calcium channels, potassium channels excitatory amino acid (EAA) receptors, nicotinic acetylcholine receptors. Assays for determining activity of such receptors can also use agonists and antagonists to use as negative or positive controls to assess activity of tested chemicals. In preferred embodiments of automated assays for identifying chemicals that have the capacity to modulate the function of receptors or ion channels (e.g., agonists, antagonists), changes in the level of ions in the cytoplasm or membrane voltage will be monitored using an ion-sensitive or membrane voltage fluorescent indicator, respectively. Among the ion-sensitive indicators and voltage probes that may be employed, are those disclosed in the Molecular Probes 1997 Catalog, herein incorporated by reference.

Other methods of the present invention concern determining the activity of receptors. Receptor activation can sometimes initiate subsequent intracellular events that release intracellular stores of calcium ions for use as a second messenger. Activation of some G-protein-coupled receptors stimulates the formation of inositol triphosphate (IP3 a G-protein coupled receptor second messenger) through phospholipase C-mediated hydrolysis of phosphatidylinositol, Berridge and Irvine (1984), Nature 312: 315-21. IP3 in turn stimulates the release of intracellular calcium ion stores. Thus, a change in cytoplasmic calcium ion levels caused by release of calcium ions from intracellular stores can be used to reliably determine G-protein-coupled receptor function. Among G-protein-coupled receptors are muscarinic acetylcholine receptors (mAChR), adrenergic receptors, serotonin receptors, dopamine receptors, angiotensin receptors, adenosine receptors, bradykinin receptors, metabotropic excitatory amino acid receptors and the like. Cells expressing such G-protein-coupled receptors may exhibit increased cytoplasmic calcium levels as a result of contribution from both intracellular stores and via activation of ion channels, in which case it may be desirable, although not necessary, to conduct such assays in calcium-free buffer, optionally supplemented with a chelating agent such as EGTA, to distinguish fluorescence response resulting from calcium release from internal stores.

Other assays can involve determining the activity of receptors which, when activated, result in a change in the level of intracellular cyclic nucleotides, e.g., cAMP, cGMP. For example, activation of some dopamine, serotonin, metabotropic glutamate receptors and muscarinic acetylcholine receptors results in a decrease in the cAMP or cGMP levels of the cytoplasm. Furthermore, there are cyclic nucleotide-gated ion channels, e.g., rod photoreceptor cell channels and olfactory neuron channels (see, Altenhofen, W. et al. (1991) Proc. Natl. Acad. Sci U.S.A. 88: 9868-9872 and Dhallan et al. (1990) Nature 347:184-187) that are permeable to cations upon activation by binding of cAMP or cGMP. In cases where activation of the receptor results in a decrease in cyclic nucleotide levels, it may be preferable to expose the cells to agents that increase intracellular cyclic nucleotide levels, e.g., forskolin, prior to adding a receptor-activating compound to the cells in the assay. Cells for this type of assay can be made by co-transfection of a host cell with DNA encoding a cyclic nucleotide-gated ion channel and DNA encoding a receptor (e.g., certain metabotropic glutamate receptors, muscarinic acetylcholine receptors, dopamine receptors, serotonin receptors, and the like), which, when activated, cause a change in cyclic nucleotide levels in the cytoplasm.

Any cell expressing a protein target in sufficient quantity for measurement in a cellular assay can be used with the invention. Cells endogenously expressing a protein can work as well as cells expressing a protein from heterologous nucleic acids. For example, cells may be transfected with a suitable vector encoding one or more such targets that are known to those of skill in the art or may be identified by those of skill in the art. Although essentially any cell which expresses endogenous ion channel or receptor activity may be used, when using receptors or channels as targets it is preferred to use cells transformed or transfected with heterologous DNAs encoding such ion channels and/or receptors so as to express predominantly a single type of ion channel or receptor. Many cells that can be genetically engineered to express a heterologous cell surface protein are known. Such cells include, but are not limited to, baby hamster kidney (BHK) cells (ATCC No. CCL10), mouse L cells (ATCC No. CCLI.3), Jurkats (ATCC No. TIB 152) and 153 DG44 cells (see, Chasin (1986) Cell. Molec. Genet. 12: 555) human embryonic kidney (HEK) cells (ATCC No. CRL1573), Chinese hamster ovary (CHO) cells (ATCC Nos. CRL9618, CCL61, CRL9096), PC12 cells (ATCC No. CRL17.21) and COS-7 cells (ATCC No. CRL1651). Preferred cells for heterologous cell surface protein expression are those that can be readily and efficiently transfected. Preferred cells include Jurkat cells and HEK 293 cells, such as those described in U.S. Pat. No. 5,024,939 and by Stillman et al. (1985) Mol. Cell. Biol. 5: 2051-2060.

Exemplary membrane proteins include, but are not limited to, surface receptors and ion channels. Surface receptors include, but are not limited to, muscarinic receptors, e.g., human M2 (GenBank accession #M16404); rat M3 (GenBank accession #M16407); human M4 (GenBank accession #M16405); human M5 (Bonner, et al., (1988) Neuron 1, pp. 403-410); and the like. Neuronal nicotinic acetylcholine receptors include, but are not limited to, e.g., the human alpha2, alpha3, and beta2, subtypes disclosed in U.S. Ser. No. 504,455 (filed Apr. 3, 1990, which is hereby expressly incorporated by reference herein in its entirety); the human as alpha5 subtype (Chini, et al. (1992) Proc. Natl. Acad. Sci. U.S.A. 89: 1572-1576), the rat alpha2 subunit (Wada, et al. (1988) Science 240, pp. 330-334); the rat alpha3 subunit (Boulter, et al. (1986) Nature 319, pp. 368-374); the rat alpha4 subunit (Goldman, et al. (1987) Cell 48, pp. 965-973); the rat alpha5 subunit (Boulter, et al. (1990) J. Biol. Chem. 265, pp. 4472-4482); the chicken alpha7 subunit (Couturier et al. (1990) Neuron 5: 847-856); the rat beta2 subunit (Deneris, et al. (1988) Neuron 1, pp. 45-54) the rat beta3 subunit (Deneris, et al. (1989) J. Biol. Chem. 264, pp. 6268-6272); the rat beta4 subunit (Duvoisin, et al. (1989) Neuron 3, pp. 487-496); combinations of the rat .alpha. subunits, .beta. subunits and a and p subunits; GABA receptors, e.g., the bovine n, and p, subunits (Schofield, et al. (1987) Nature 328, pp. 221-227); the bovine n, and a, subunits (Levitan, et al. (1988) Nature 335, pp. 76-79); the .gamma.-subunit (Pritchett, et al. (1989) Nature 338, pp. 582-585); the p, and p, subunits (Ymer, et al. (1989) EMBO J. 8, pp. 1665-1670); the 6 subunit (Shivers, B. D. (1989) Neuron 3, pp. 327-337); and the like. Glutamate receptors include, but are not limited to, e.g., rat GluR1 receptor (Hollman, et al. (1989) Nature 342, pp. 643-648); rat GluR2 and GluR3 receptors (Boulter et al. (1990) Science 249:1033-1037; rat GluR4 receptor (Keinanen et al. (1990) Science 249: 556-560); rat GluR5 receptor (Bettler et al. (1990) Neuron 5: 583-595) g rat GluR6 receptor (Egebjerg et al. (1991) Nature 351: 745-748); rat GluR7 receptor (Bettler et al. (1992) neuron 8:257-265); rat NMDAR1 receptor (Moriyoshi et al. (1991) Nature 354:31-37 and Sugihara et al. (1992) Biochem. Biophys. Res. Comm. 185:826-832); mouse NMDA el receptor (Meguro et al. (1992) Nature 357: 70-74); rat NMDAR2A, NMDAR2B and NMDAR2C receptors (Monyer et al. (1992) Science 256: 1217-1221); rat metabotropic mGluR1 receptor (Houamed et al. (1991) Science 252: 1318-1321); rat metabotropic mGluR2, mGluR3 and mGluR4 receptors (Tanabe et al. (1992) Neuron 8:169-179); rat metabotropic mGluR5 receptor (Abe et al. (1992) J. Biol. Chem. 267: 13361-13368); and the like. Adrenergic receptors include, but are not limited to, e.g., human pl (Frielle, et al. (1987) Proc. Natl. Acad. Sci. 84, pp. 7920-7924); human alpha2 (Kobilka, et al. (1987) Science 238, pp. 650-

656); hamster beta2 (Dixon, et al. (1986) Nature 321, pp. 75-79); and the like. Dopamine receptors include, but are not limited to, e.g., human D2 (Stormann, et al. (1990) Molec. Pharm. 37, pp. 1-6); mammalian dopamine D2 receptor (U.S. Pat. No. 5,128,254); rat (Bunzow, et al. (1988) Nature 336, pp. 783-787); and the like. NGF receptors include, but are not limited to, e.g., human NGF receptors (Johnson, et al. (1986) Cell 47, pp. 545-554); and the like. Serotonin receptors include, but are not limited to, e.g., human 5HT1a (Kobilka, et al. (1987) Nature 329, pp. 75-79); serotonin 5HT1C receptor (U.S. Pat. No. 4,985,352); human 5HT1D (U.S. Pat. No. 5,155,218); rat 5HT2 (Julius, et al. (1990) PNAS 87, pp. 928-932); rat 5HT1c (Julius, et al. (1988) Science 241, pp. 558-564); and the like.

Ion channels include, but are not limited to, calcium channels comprised of the human calcium channel (alpha2beta and/or gamma-subunits disclosed in commonly owned U.S. application Ser. Nos. 07/745,206 and 07/868,354, filed Aug. 15, 1991 and Apr. 10, 1992, respectively, the contents of which are hereby incorporated by reference; (see also, W089/09834; human neuronal alpha2 subunit); rabbit skeletal muscle al subunit (Tanabe, et al. (1987) Nature 328, pp. 313-E318); rabbit skeletal muscle alpha2 subunit (Ellis, et al. (1988) Science 241, pp. 1661-1664); rabbit skeletal muscle p subunit (Ruth, et al. (1989) Science 245, pp. 1115-1118); rabbit skeletal muscle .gamma. subunit (Jay, et al. (1990) Science 248, pp. 490-492); and the like. Potassium ion channels include, but are not limited to, e.g., rat brain (BK2) (McKinnon, D. (1989) J. Biol Chem. 264, pp. 9230-8236); mouse brain (BK1) (Tempel, et al. (1988) Nature 332, pp. 837-839); and the like. Sodium ion channels include, but are not limited to, e.g., rat brain I and II (Noda, et al. (1986) Nature 320, pp. 188-192); rat brain III (Kayano, et al. (1988) FEBS Lett. 228, pp. 187-194); human II (ATCC No. 59742, 59743 and Genomics 5: 204-208 (1989); chloride ion channels (Thiemann, et al. (1992), Nature 356, pp. 57-60 and Paulmichl, et al. (1992) Nature 356, pp. 238-241), and others known or developed in the art.

Intracellular receptors may also be used as targets, such as estrogen receptors, glucocorticoid receptors, androgen receptors, progesterone receptors, and mineralocorticoid receptors, in the invention. Transcription factors and kinases can also be used as targets, as well as plant targets.

Various methods of identifying activity of chemical with respect to a target can be applied, including: ion channels (PCT publication WO 93/13423) and intracellular receptors (PCT publication WO 96/41013, U.S. Pat. No. 5,548,063, U.S. Pat. No. 5,171,671, U.S. Pat. No. 5,274,077, U.S. Pat. No. 4,981,784, EP 0 540 065 A1, U.S. Pat. No. 5,071,773, and U.S. Pat. No. 5,298,429). All of the foregoing references are herein incorporated by reference in their entirety.

If the analyte is present in the sample, then the target will exhibit increased or decreased fluorescence. Such fluorescence can be detected using the methods of the present invention by exciting the sample with radiation of a first wavelength, which excites a fluorescent reporter in the sample, which emits radiation of a second wavelength, which can be detected. The amount of the emission is measured, and compared to proper control or background values. The amount of emitted radiation that differs from the background and control levels, either increased or decreased, correlates with the amount or potency of the analyte in the sample. Standard curves can be determined to make the assay more quantitative.

Testing a Therapeutic for Therapeutic Activity and Toxicology

The present invention also provides a method for testing a therapeutic for therapeutic activity and toxicology. A therapeutic is identified by contacting a test chemical suspected of having a modulating activity of a biological process or target with a biological process or target in a multi-well platform of the present invention. If the sample contains a modulator, then the amount of a fluorescent reporter product in the sample, such as inside or outside of the cell, will either increase or decrease relative to background or control levels. The amount of the fluorescent reporter product is measured by exciting the fluorescent reporter product with an appropriate radiation of a first wavelength and measuring the emission of radiation of a second wavelength emitted from said sample. The amount of emission is compared to background or control levels of emission. If the sample having the test chemical exhibits increased or decreased emission relative to that of the control or background levels, then a candidate modulator has been identified. The amount of emission is related to the amount or potency of the therapeutic in the sample. Such methods are described in, for example, Tsien (PCT/US90/04059) The candidate modulator can be further characterized and monitored for structure, potency, toxicology, and pharmacology using well known methods.

The structure of a candidate modulator identified by the invention can be determined or confirmed by methods known in the art, such as mass spectroscopy. For putative modulators stored for extended periods of time, the structure, activity, and potency of the putative modulator can be confirmed.

Depending on the system used to identify a candidate modulator, the candidate modulator will have putative pharmacological activity. For example, if the candidate modulator is found to inhibit T-cell proliferation (activation) in vitro, then the candidate modulator would have presumptive pharmacological properties as an immunosuppressant or anti-inflammatory (see, Suthanthiran et al., Am. J. Kidney Disease, 28:159-172 (1996)). Such nexuses are known in the art for several disease states, and more are expected to be discovered over time. Based on such nexuses, appropriate confirmatory in vitro and in vivo models of pharmacological activity, as well as toxicology, can be selected. The methods described herein can also be used to assess pharmacological selectivity and specificity, and toxicity.

Toxicology of Candidate Modulators

Once identified, candidate modulators can be evaluated for toxicological effects using known methods (see, Lu, Basic Toxicology, Fundamentals, Target Organs, and Risk Assessment, Hemisphere Publishing Corp., Washington (1985); U.S. Pat. No. 5,196,313 to Culbreth (issued Mar. 23, 1993) and U.S. Pat. No. 5,567,952 to Benet (issued Oct. 22, 1996). For example, toxicology of a candidate modulator can be established by determining in vitro toxicity towards a cell line, such as a mammalian i.e. human, cell line. Candidate modulators can be treated with, for example, tissue extracts, such as preparations of liver, such as microsomal preparations, to determine increased or decreased toxicological properties of the chemical after being metabolized by a whole organism. The results of these types of studies are often predictive of toxicological properties of chemicals in animals, such as mammals, including humans.

Alternatively, or in addition to these in vitro studies, the toxicological properties of a candidate modulator in an animal model, such as mice, rats, rabbits, or monkeys, can be determined using established methods (see, Lu, supra (1985); and Creasey, Drug Disposition in Humans, The Basis of Clinical Pharmacology, Oxford University Press, Oxford (1979)). Depending on the toxicity, target organ, tissue, locus, and presumptive mechanism of the candidate modulator, the skilled artisan would not be burdened to determine appropriate doses, LD.sub.50 values, routes of administration, and regimes that would be appropriate to determine the toxicological properties of the candidate modulator. In addition to animal models, human clinical trials can be performed following established procedures, such as those set forth by the United States Food and Drug Administration (USFDA) or equivalents of other governments. These toxicity studies provide the basis for determining the efficacy of a candidate modulator in vivo.

Efficacy of Candidate Modulators

Efficacy of a candidate modulator can be established using several art recognized methods, such as in vitro methods, animal models, or human clinical trials (see, Creasey, supra (1979)). Recognized in vitro models exist for several diseases or conditions. For example, the ability of a chemical to extend the life-span of HIV-infected cells in vitro is recognized as an acceptable model to identify chemicals expected to be efficacious to treat HIV infection or AIDS (see, Daluge et al., Antimicro. Agents Chemother. 41:1082-1093 (1995)). Furthermore, the ability of cyclosporin A (CsA) to prevent proliferation of T-cells in vitro has been established as an acceptable model to identify chemicals expected to be efficacious as immunosuppressants (see, Suthanthiran et al., supra, (1996)). For nearly every class of therapeutic, disease, or condition, an acceptable in vitro or animal model is available. Such models exist, for example, for gastro-intestinal disorders, cancers, cardiology, neurobiology, and immunology. In addition, these in vitro methods can use tissue extracts, such as preparations of liver, such as microsomal preparations, to provide a reliable indication of the effects of metabolism on the candidate modulator. Similarly, acceptable animal models may be used to establish efficacy of chemicals to treat various diseases or conditions. For example, the rabbit knee is an accepted model for testing chemicals for efficacy in treating arthritis (see, Shaw and Lacy, J. Bone Joint Surg. (Br) 55:197-205 (1973)). Hydrocortisone, which is approved for use in humans to treat arthritis, is efficacious in this model which confirms the validity of this model (see, McDonough, Phys. Ther. 62:835-839 (1982)). When choosing an appropriate model to determine efficacy of a candidate modulator, the skilled artisan can be guided by the state of the art to choose an appropriate model, dose, and route of administration, regime, and endpoint and as such would not be unduly burdened In addition to animal models, human clinical trials can be used to determine the efficacy of a candidate modulator in humans. The USFDA, or equivalent governmental agencies, have established procedures for such studies.

Selectivity of Candidate Modulators

The in vitro and in vivo methods described above also establish the selectivity of a candidate modulator. It is recognized that chemicals can modulate a wide variety of biological processes or be selective. Panels of cells based on the present invention can be used to determine the specificity of the candidate modulator. Selectivity is evident, for example, in the field of chemotherapy, where the selectivity of a chemical to be toxic towards cancerous cells, but not towards non-cancerous cells, is obviously desirable. Selective modulators are preferable because they have fewer side effects in the clinical setting. The selectivity of a candidate modulator can be established in vitro by testing the toxicity and effect of a candidate modulator on a plurality of cell lines that exhibit a variety of cellular pathways and sensitivities. The data obtained from these in vitro toxicity studies can be extended animal model studies, including human clinical trials, to determine toxicity, efficacy, and selectivity of the candidate modulator.

Identified Compositions

The invention includes compositions such as novel chemicals, and therapeutics identified as having activity by the operation of methods, systems or components described herein. Novel chemicals, as used herein, do not include chemicals already publicly known in the art as of the filing date of this application. Typically, a chemical would be identified as having activity from using the invention and then its structure revealed from a proprietary database of chemical structures or determined using analytical techniques such as mass spectroscopy.

One embodiment of the invention is a chemical with useful activity, comprising a chemical identified by the method described above. Such compositions include small organic molecules, nucleic acids, peptides and other molecules readily synthesized by techniques available in the art and developed in the future. For example, the following combinatorial compounds are suitable for screening: peptoids (PCT Publication No. WO 91/19735, Dec. 26, 1991), encoded peptides (PCT Publication No. WO 93/20242, Oct. 14, 1993), random bio-oligomers (PCT Publication WO 92/00091, Jan. 9, 1992), benzodiazepines (U.S. Pat. No. 5,288,514), diversomeres such as hydantoins, benzodiazepines and dipeptides (Hobbs DeWitt, S. et al., Proc. Nat. Acad. Sci. USA 90: 6909-6913 (1993)), vinylogous polypeptides (Hagihara et al., J. Amer. Chem. Soc. 114: 6568 (1992)), nonpeptidal peptidomimetics with a Beta-D-Glucose scaffolding (Hirschmann, R. et al., J. Amer. Chem. Soc. 114: 9217-9218 (1992)), analogous organic syntheses of small compound libraries (Chen, C. et al., J. Amer. Chem. Soc. 116:2661 (1994)), oligocarbamates (Cho, C. Y. et al., Science 261: 1303 (1993)), and/or peptidyl phosphonates (Campbell, D. A. et al., J. Org. Chem. 59: 658 (1994)). See, generally, Gordon, E. M. et al., J. Med Chem. 37: 1385 (1994). The contents of all of the aforementioned publications are incorporated herein by reference.

The present invention also encompasses the identified compositions in a pharmaceutical compositions comprising a pharmaceutically acceptable carrier prepared for storage and subsequent administration, which have a pharmaceutically effective amount of the products disclosed above in a pharmaceutically acceptable carrier or diluent. Acceptable carriers or diluents for therapeutic use are well known in the pharmaceutical art, and are described, for example, in Remington's Pharmaceutical Sciences, Mack Publishing Co. (A. R. Gennaro edit. 1985). Preservatives, stabilizers, dyes and even flavoring agents may be provided in the pharmaceutical composition. For example, sodium benzoate, sorbic acid and esters of p-hydroxybenzoic acid may be added as preservatives. In addition, antioxidants and suspending agents may be used.

The compositions of the present invention may be formulated and used as tablets, capsules or elixirs for oral administration; suppositories for rectal administration; sterile solutions, suspensions for injectable administration; and the like. Injectables can be prepared in conventional forms, either as liquid solutions or suspensions, solid forms suitable for solution or suspension in liquid prior to injection, or as emulsions. Suitable excipients are, for example, water, saline, dextrose, mannitol, lactose, lecithin, albumin, sodium glutamate, cysteine hydrochloride, and the like. In addition, if desired, the injectable pharmaceutical compositions may contain minor amounts of nontoxic auxiliary substances, such as wetting agents, pH buffering agents, and the like. If desired, absorption enhancing preparations (e.g., liposomes), may be utilized.

The pharmaceutically effective amount of the composition required as a dose will depend on the route of administration, the type of animal being treated, and the physical characteristics of the specific animal under consideration. The dose can be tailored to achieve a desired effect, but will depend on such factors as weight, diet, concurrent medication and other factors which those skilled in the medical arts will recognize.

In practicing the methods of the invention, the products or compositions can be used alone or in combination with one another, or in combination with other therapeutic or diagnostic agents. These products can be utilized in vivo, ordinarily in a mammal, preferably in a human, or in vitro. In employing them in vivo, the products or compositions can be administered to the mammal in a variety of ways, including parenterally, intravenously, subcutaneously, intramuscularly, colonically, rectally, nasally or intraperitoneally, employing a variety of dosage forms. Such methods may also be applied to testing chemical activity in vivo.

As will be readily apparent to one skilled in the art, the useful in vivo dosage to be administered and the particular mode of administration will vary depending upon the age, weight and mammalian species treated, the particular compounds employed, and the specific use for which these compounds are employed. The determination of effective dosage levels, that is the dosage levels necessary to achieve the desired result, can be accomplished by one skilled in the art using routine pharmacological methods. Typically, human clinical applications of products are commenced at lower dosage levels, with dosage level being increased until the desired effect is achieved. Alternatively, acceptable in vitro studies can be used to establish useful doses and routes of administration of the compositions identified by the present methods using established pharmacological methods.

In non-human animal studies, applications of potential products are commenced at higher dosage levels, with dosage being decreased until the desired effect is no longer achieved or adverse side effects disappear. The dosage for the products of the present invention can range broadly depending upon the desired affects and the therapeutic indication. Typically, dosages may be between about 10 kg/kg and 100 mg/kg body weight, preferably between about 100.mu.g/kg and 10 mg/kg body weight. Administration is preferably oral on a daily basis.

The exact formulation, route of administration and dosage can be chosen by the individual physician in view of the patient's condition. (See e.g., Fingl et al., in The Pharmacological Basis of Therapeutics, 1975). It should be noted that the attending physician would know how to and when to terminate, interrupt, or adjust administration due to toxicity, or to organ dysfunctions. Conversely, the attending physician would also know to adjust treatment to higher levels if the clinical response were not adequate (precluding toxicity). The magnitude of an administrated dose in the management of the disorder of interest will vary with the severity of the condition to be treated and to the route of administration. The severity of the condition may, for example, be evaluated, in part, by standard prognostic evaluation methods. Further, the dose and perhaps dose frequency, will also vary according to the age, body weight, and response of the individual patient. A program comparable to that discussed above may be used in veterinary medicine.

Depending on the specific conditions being treated, such agents may be formulated and administered systemically or locally. Techniques for formulation and administration may be found in Remington's Pharmaceutical Sciences, 18th Ed., Mack Publishing Co., Easton, Pa. (1990). Suitable routes may include oral, rectal, transdermal, vaginal, transmucosal, or intestinal administration; parenteral delivery, including intramuscular, subcutaneous, intramedullary injections, as well as intrathecal, direct intraventricular, intravenous, intraperitoneal, intranasal, or intraocular injections.

For injection, the agents of the invention may be formulated in aqueous solutions, preferably in physiologically compatible buffers such as Hanks' solution, Ringer's solution, or physiological saline buffer. For such transmucosal administration, penetrants appropriate to the barrier to be permeated are used in the formulation. Such penetrants are generally known in the art. Use of pharmaceutically acceptable carriers to formulate the compounds herein disclosed for the practice of the invention into dosages suitable for systemic administration is within the scope of the invention. With proper choice of carrier and suitable manufacturing practice, the compositions of the present invention, in particular, those formulated as solutions, may be administered parenterally, such as by intravenous injection. The compounds can be formulated readily using pharmaceutically acceptable carriers well known in the art into dosages suitable for oral administration. Such carriers enable the compounds of the invention to be formulated as tablets, pills, capsules, liquids, gels, syrups, slurries, suspensions and the like, for oral ingestion by a patient to be treated.

Agents intended to be administered intracellularly may be administered using techniques well known to those of ordinary skill in the art. For example, such agents may be encapsulated into liposomes, then administered as described above. All molecules present in an aqueous solution at the time of liposome formation are incorporated into the aqueous interior. The liposomal contents are both protected from the external micro-environment and, because liposomes fuse with cell membranes, are efficiently delivered into the cell cytoplasm. Additionally, due to their hydrophobicity, small organic molecules may be directly administered intracellularly.

Pharmaceutical compositions suitable for use in the present invention include compositions wherein the active ingredients are contained in an effective amount to achieve its intended purpose. Determination of the effective amounts is well within the capability of those skilled in the art, especially in light of the detailed disclosure provided herein. In addition to the active ingredients, these pharmaceutical compositions may contain suitable pharmaceutically acceptable carriers comprising excipients and auxiliaries which facilitate processing of the active compounds into preparations which can be used pharmaceutically. The preparations formulated for oral administration may be in the form of tablets, dragees, capsules, or solutions. The pharmaceutical compositions of the present invention may be manufactured in a manner that is itself known, e.g., by means of conventional mixing, dissolving, granulating, dragee-making, levitating, emulsifying, encapsulating, entrapping, or lyophilizing processes.

Pharmaceutical formulations for parenteral administration include aqueous solutions of the active compounds in water-soluble form. Additionally, suspensions of the active compounds may be prepared as appropriate oily injection suspensions. Suitable lipophilic solvents or vehicles include fatty oils such as sesame oil, or synthetic fatty acid esters, such as ethyl oleate or triglycerides, or liposomes. Aqueous injection suspensions may contain substances which increase the viscosity of the suspension, such as sodium carboxymethyl cellulose, sorbitol, or dextran. Optionally, the suspension may also contain suitable stabilizers or agents that increase the solubility of the compounds to allow for the preparation of highly concentrated solutions.

Pharmaceutical preparations for oral use can be obtained by combining the active compounds with solid excipient, optionally grinding a resulting mixture, and processing the mixture of granules, after adding suitable auxiliaries, if desired, to obtain tablets or dragee cores. Suitable excipients are, in particular, fillers such as sugars, including lactose, sucrose, mannitol, or sorbitol; cellulose preparations such as, for example, maize starch, wheat starch, rice starch, potato starch, gelatin, gum tragacanth, methyl cellulose, hydroxypropylmethyl-cellulose, sodium carboxymethylcellulose, and/or polyvinylpyrrolidone (PVP). If desired, disintegrating agents may be added, such as the cross-linked polyvinyl pyrrolidone, agar, or alginic acid or a salt thereof such as sodium alginate. Dragee cores are provided with suitable coatings. For this purpose, concentrated sugar solutions may be used, which may optionally contain gum arabic, talc, polyvinyl pyrrolidone, carbopol gel, polyethylene glycol, and/or titanium dioxide, lacquer solutions, and suitable organic solvents or solvent mixtures. Dye-stuffs or pigments may be added to the tablets or dragee coatings for identification or to characterize different combinations of active compound doses.

The following examples are intended to illustrate but not to limit the invention in any manner, shape, or form, either explicitly or implicitly. While they are typical of those that might be used, other procedures, methodologies, or techniques known to those skilled in the art may alternatively be used.

Example 1

High Density Multi-Well Platform

FIGS. 6*a*-6*f* show a multi-well platform 60 in accordance with a preferred embodiment. Specifically, FIGS. 6*a*-6*f* respectively, schematically illustrate top, bottom, front, rear and opposing side views of a multiple-well plate 60 in accordance with a preferred embodiment.

An injection molded multi-well plate 60 was made such that the inner array of 3456 wells (48×72 wells) extended completely through the platform from top to bottom while the two outermost rows and two outermost columns of wells 62 (244 wells) extended only halfway through the platform from the top to provide evaporation control (see FIGS. 3*a*-3*b*, 4*b* and 5 and corresponding description above). This illustrative multi-well platform 60 shown comprises a frame wherein the wall of a well is disposed in the frame. The frame is 3.25 mm thick. On the top part of the frame in the area completely surrounding the frame, topological markings were molded to provide reference coordinates 64 for the wells. In between the markings 64 and the edge of the plate 60 running along the width of the platform were evenly spaced depressions serving as tool points for the ejection of the molded honeycomb from the mold. The frame was made of the cyclo-olefin copolymer Zeonor 750R which was made optically opaque by the addition of 2% black pigment. The frame is substantially flat. Along the outer edge of the top surface is a groove 38*a* that ran uninterrupted completely around the side of the plate 60. This groove 38*a* accommodated a lid (not shown, but see FIGS. 3*a*-3*b*) whose inner face nearly contacted the top surface of the honeycomb well array and whose outer edge contacted the bottom surface of the groove 38*a*. This provided substantially complete sealing of the well contents from the outside. The flange 72 of the plate 60 was molded as part of the platform. For example, the lid may leave a spacing of less than ⅛, or even 1/16, of an inch from the tops of the wells.

Each well had a bottom 74 with a high transmittance portion with a thickness of 100 μm that was made of a clear, flat Zeonor 750R film sheet. The frame and bottom 74 were joined by heat sealing to form the wells. The well-center-to-well-center distance was 1.5 mm. The diameter of each well at the top was 1.1 mm and the diameter of each well that extended entirely through the platform was 0.9 mm at the bottom 74.

In a second embodiment, the center-to-center spacing of the wells was 2.25 mm, such that the honeycomb consisted of an array of 1546 wells (32×48 wells) that extended completely through the honeycomb to provide sample wells. This well array was completely surrounded on its outer edge by an additional two rows and two columns of wells which extended only half-way through the honeycomb to provide an evaporation barrier. Thus, these 1536 sample well plates contained a total of 1700 sample and evaporation control wells, and are referred to as 1536 well plates. The volume of each sample well was approximately 10 μL.

These multi-well platforms were used in the spectrometric assays described in the following examples, and/or may be used in accordance with a preferred or alternative embodiment.

Example 2

Dispensing Compounds to a Multi-Well Plate and Spectrometric Detection of Dispensed Liquid In this example, chemical compounds were dispensed into a multi-well plate constructed as described in Example 1. The compounds were mixed with a fluorescent marker to enable determination of whether liquid was successfully dispensed to each well.

A series of chemical compound concentrates dissolved in 75:25 (by volume) DMSO:water stored in a 1536-well plate were dispensed to a second, initially empty, 1536-well plate. Dispensing was performed by using a commercially available automated liquid-handling system (Sciclone, Zymark Corp., Woburn, Mass.). The volume of compound concentrate dispensed to each well was 6.4 μL. Then 0.7 μL of a solution of 2 mM fluorescein dissolved in 75:25 DMSO:water was dispensed to each well on top of the 6.4 μL of compound concentrate previously dispensed to each well by using a pressure-driven solenoid-actuated dispenser (described in more detail in Example 4). The plate was fitted with a lid and allowed to rest for 24 hr in the dark to allow the fluorescein to diffuse throughout the 7.1 μL liquid volume of the well. A second 1536-well plate was prepared without compounds in which each well was filled with 6.4 μL DMSO:water and 0.7 μL of 2 mM fluorescein. This second plate served as a control to determine whether a compound could (1) alter the fluorescence of fluorescein by quenching or other fluorescence interaction or (2) possess intrinsic fluorescence.

Figure 7:
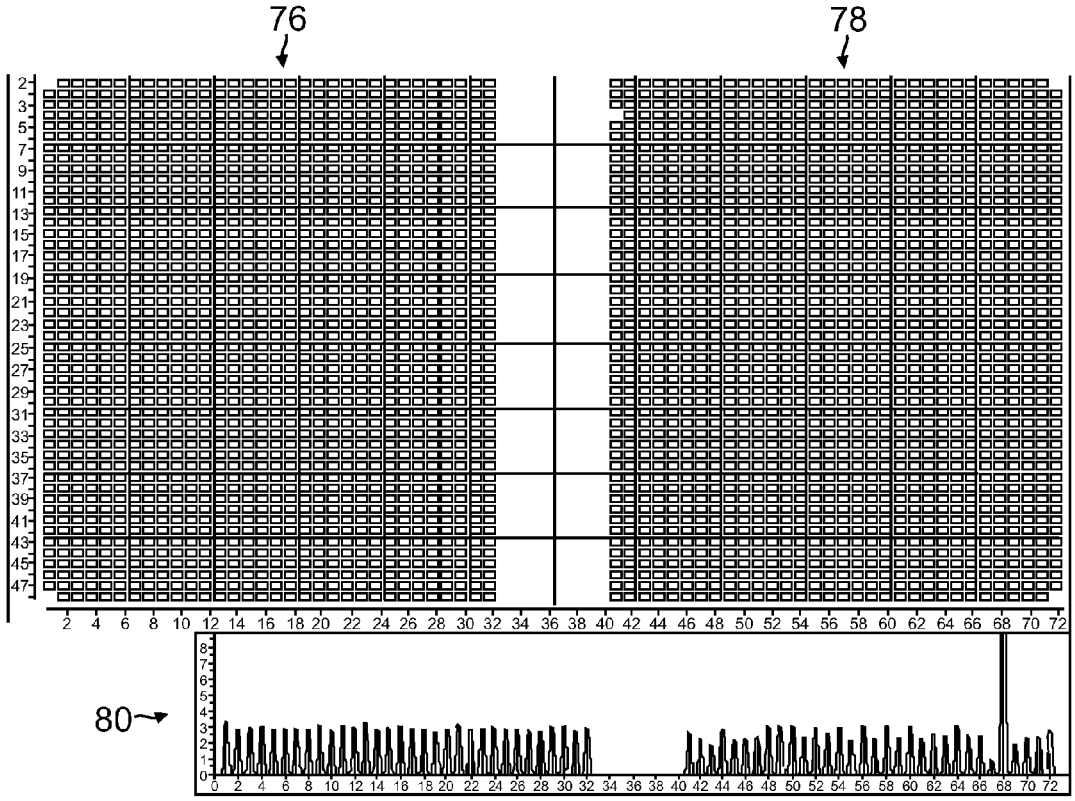
FIG. 7 illustrates results of a measurement of fluorescence from contents of each well in a pair of two-dimensional arrays of wells, with one array including chemical compound and the other not including the chemical compound.

The fluorescence of each well in both plates was measured through the bottom using an illumination-emission reading system that enabled scanning of the bottom of each well in an entire 3456-well plate. In this fluorescence reader, each well of a plate was centered over an optical element that enabled illumination of the well through the clear bottom of the plate by light from a 100 W Hg lamp that was passed through a 460/30 nm bandpass filter and then ducted to the optical element by optical fiber. The same optical element was used to collect the light emitted by the exited fluorescein in the well, which emanated through the clear well bottom. This light was transmitted by additional optical fibers to a 530 nm longpass filter situated in front of a photomultiplier tube that was used to record the fluorescence signal from each well. The two plates were scanned with the same In FIG. 7, the intensity of fluorescein in each well is shown as a two-dimsensional array. The emission recorded by the photomultiplier tube was integrated over each well, and the resulting intensities mapped to a gray scale and plotted as a 32×48 array. The results for the two plates are shown side by side. The plate 76 containing only fluorescein in DMSO: water is shown on the left and the plate 78 containing the chemical compounds and fluorescein are shown on the right. Below the two-dimensional intensity map is a plot 80 of the photomultiplier output recorded for one of the rows. The system is configured for viewing the outputs of the rows on a row-by-row basis. The output trace shown in FIG. 7 is exemplary.

In the plate 76 on the left, containing only fluorescein, the well intensities appear very similar with little variation between wells. This is confirmed in the lower exemplary trace for the illustrative row, in which none of wells exhibit particularly high or low fluorescence intensities. This suggests fluorescent chemical can be quantitatively distributed to all the wells of the multi-well platform according to a preferred embodiment. In the plate 78 on the right, the well intensities exhibit greater variation, with some wells showing large intensities. This suggests that these compounds may interact with fluorescein to alter its fluorescence emission, such that care will need to be taken in subsequent spectrometric assays with these compounds using assay reagents similar to fluorescein.

This example shows that an advantageous multi-well platform described in accordance with a preferred embodiment can have liquid chemicals dispensed to it, and quantitative fluorescence measurements can subsequently be performed in the platform.

Example 3

Control of Liquid Sample Evaporation in the Multi-Well Platform

In this example, the wells (e.g., element 22 of FIGS. 3*a*-3*b*) that are along the edge of the well array and extend only halfway through the platform are used to prevent evaporation of the fluid contents in the wells (e.g., elements 12 of FIGS. 3*a*-3*b*) that extend all the way through the platform.

In this example, each well in a 3456-well plate constructed as described in Example 1 was filled with 2 μL of fluorescein using the pressure-driven solenoid actuated dispensing system described in example 4. In addition, each of the 244 evaporation control wells received 1.0 μL of DMSO:water. A second 3456-well plate, not constructed with the evaporation control wells or other features in accordance with a preferred embodiment, was prepared in which the sample wells were filled with 2 μL of fluorescein by using the same dispensing methodology as described for the first plate. The plates were fitted with lids, and the fluorescence of each well was read at 2 hr and then at 24 hr post-filling.

The effect of the evaporation control wells is now discussed. In the plate in which the evaporation control wells were filled with DMSO:water, the fluorescence intensities of all the wells were observed to be very similar even after 24 hr. By contrast, the wells in which the evaporation control wells were not filled with liquid, the fluorescence intensities are more variable between the wells, particularly along the rows and columns comprising the outermost edge of the array. This indicates that the liquid in the evaporation control wells is able to decrease the loss of volume in the sample wells of the multi-well platform. This evaporative loss in the uncontrolled plate is capable of altering the fluorescence intensity of a sample relative to other samples even when all the samples are identical. Thus, without control of evaporative losses, spectrometric assays become less reliable when the assays are performed under the assumption that each well contains a specific quantity of a fluorescent marker that will provide a control intensity.

This example shows that the evaporation control wells of the multi-well described in accordance with a preferred embodiment are able to prevent alterations in fluorescence intensity due to evaporative changes in the sample volumes of the wells.

Example 4

Dispensing from one High-Density Source Plate into a Second High-Density Destination Plate In this example, a small volume of a concentrated solution of the fluorescent marker fluorescein is transferred from a high-density multi-well plate to a second high-density multi-well plate and its fluorescence is measured. Each of the 3456 sample wells of a 3456-well high density multi-well plate was filled with 2 μL of a solution of 50 μM fluorescein dissolved in a 75:25 (by volume) mixture of DMSO and water. The fluorescein was loaded into the source plate using a robotic X-Y motion stage that brought the center of each well directly under a single dispenser orifice 200 μm in diameter. The dispenser orifice, located at the bottom of a stainless steel shaft, was connected to a reservoir containing the concentrated solution of the fluorescein that was pressurized to 8 psi. A solenoid valve interposed between the reservoir and the dispensing orifice was actuated for a controlled duration in order to eject the concentrate into each well, and then the plate was positioned to bring the next well under the dispenser. After this source plate was filled, it was mounted top-side up in a robotic positioner that allowed the bottom of each well to be positioned over a single miniaturized acoustic lens (Elrod, S. A., B. T. Khuri-Yakub, C. F. Quate. 1988. "Acoustic lens arrays for ink printing", U.S. Pat. No. 4,751,530, hereby incorporated by reference in its entirety) obtained from EDC Biosystems, Inc. of San Jose, Calif. A second, empty 3456-well plate, to serve as the destination platform, was mounted upside down onto the top of the first plate. The upside down second plate was positioned in registration with the source plate so that each well of the upside down plate was positioned directly over the top opening of the corresponding well in the source plate. To dispense from the source plate to the destination plate, the acoustic lens was positioned near the center of each well. Acoustic contact was made by means of a fountain of liquid that flowed up around the lens and adhered to the bottom of the well. The lens was actuated in a manner to eject a 10 nL droplet of the fluorescein concentrate from the surface of the liquid in the source well and into the inverted destination well above it. This procedure was repeated for each well in the source plate by repositioning the pair of plates over the acoustic lens and actuating a dispense until all sample wells of the destination plate received a 10 nL aliquot of the source fluorescein. Each well in the destination plate was subsequently filled with 2 μL of 75:25 DMSO:water using the solenoid valve-actuated dispenser described above. The fluorescence of fluorescein in each well was read with a fluorescence excitation-emission optical system that employed a photomultiplier tube to measure the emitted light intensity of each well.

Figure 8A:
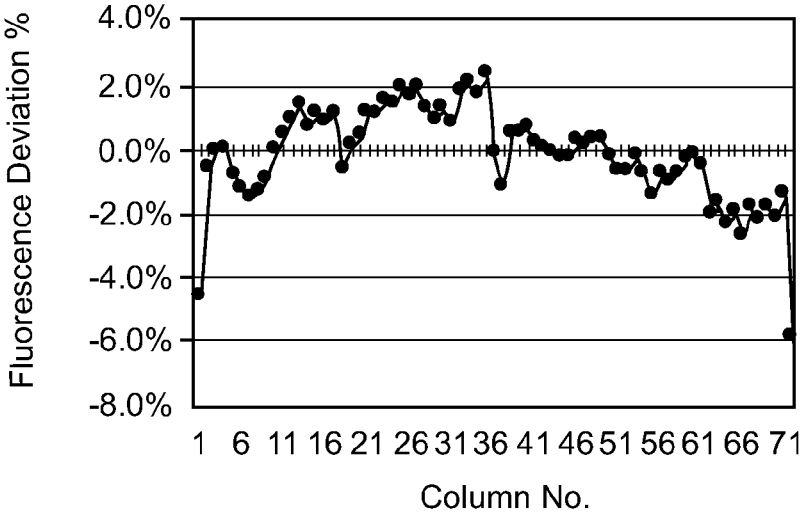
FIGS. 8*a*-8*b* illustrate fluorescence measurements of corresponding rows of 72 wells for target and destination plates in accordance with a preferred embodiment.
Figure 8B:
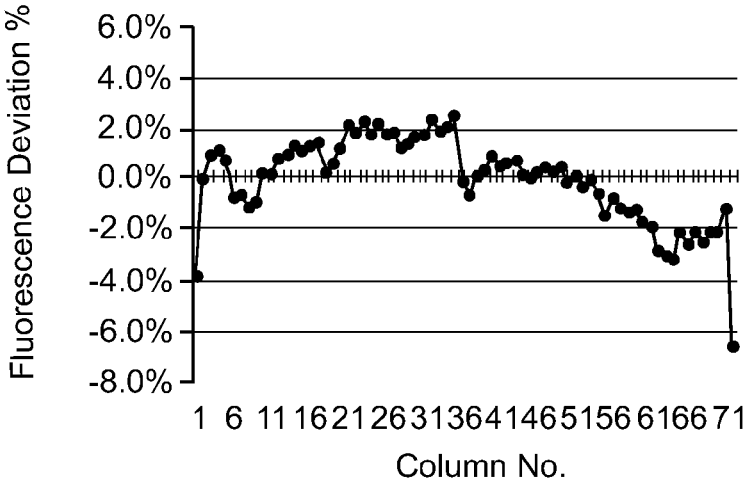

The fluorescence readings obtained for two rows of 72 wells are illustrated in separate plots in FIGS. 8*a*-8*b*. The reading for each well is depicted as the percentage deviation of that well's fluorescence intensity from the average fluorescence intensity for all 72 wells in both rows. The maximum deviations were at the wells at the ends of the row, and the greatest deviation of any well's fluorescence from the average fluorescence intensity of the row was about 6%. The coefficient of variation (standard deviation divided by the average intensity) for all 3456 wells on the plate was 6.5%. Based on calibrations in which the photomultiplier tube intensity was recorded for well concentrations of fluorescein ranging from 100 nM to 50 μM, the average target well concentration was approximately 250 nM. For all 3456 wells in the plate, the standard deviation of the fluorescence was approximately 7% of the average intensity. This indicated that approximately the same volume of fluorescein concentrate was successfully delivered to each well. Thus, the multi-well platform can be used to store chemical concentrates, and these concentrates can be dispensed directly from storage to a second multi-well plate that is used for fluorescence measurement.

Figure 8C:
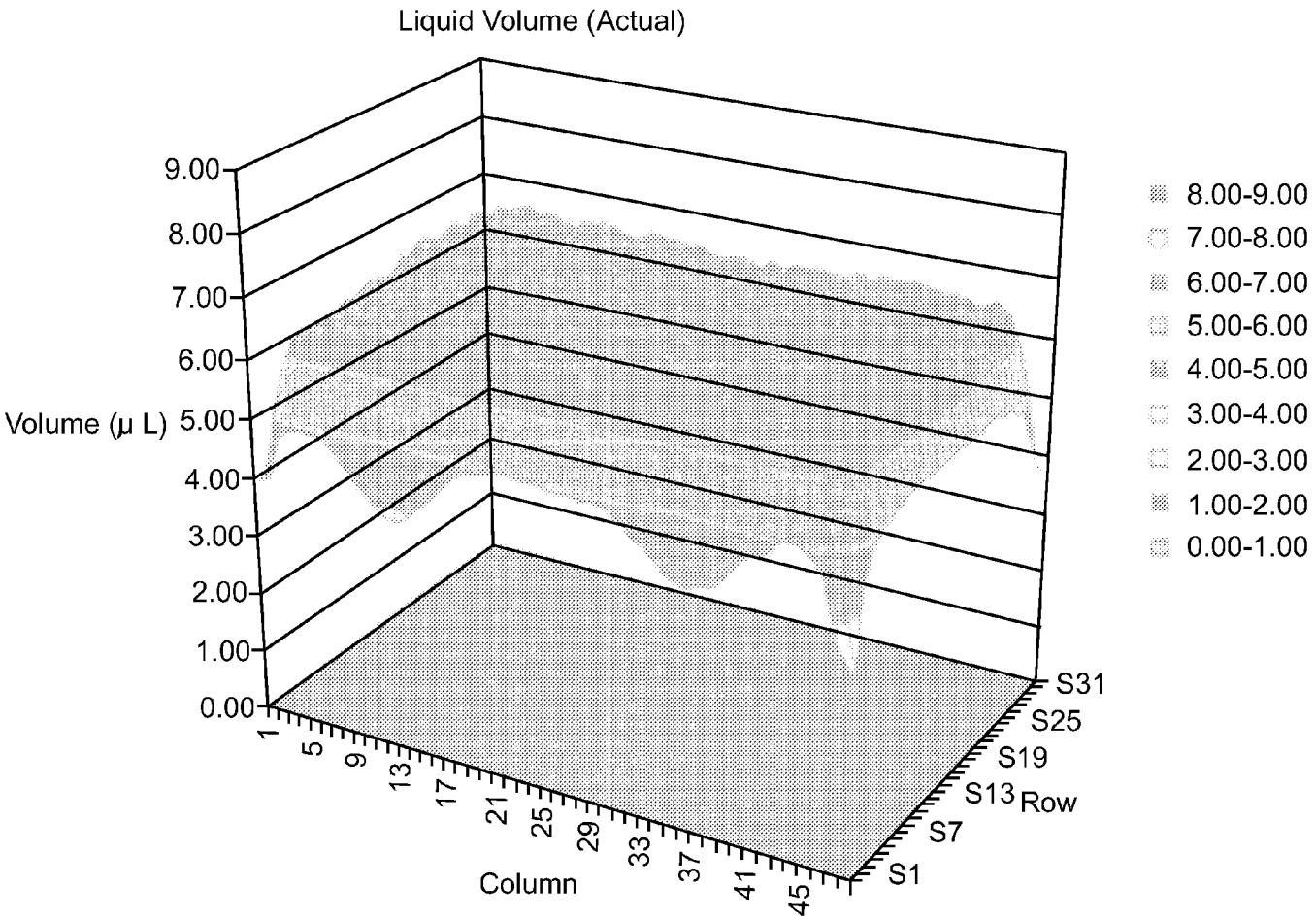
FIG. 8*c* illustrates a plate with stored with a simple lid (and not the advantageous lid described in accordance with preferred embodiments below), and shows fluorescence measurements corresponding to volumes of material in the wells.

FIG. 8*c* illustrates results of a separate measurement with a 1536 well plate. Each well of the 1536-well plate was filled with slightly over 6 microliters of water. The plate was covered with a simple lid. The bottom surface of the lid was substantially close to the tops of the wells, but the outer edge of the lid did not make a seal with the plate. The lidded plate was left at room temperature for 24 hours. The liquid height in each well was then determined acoustically using the EDC Biosystems acoustic dispensing tool. Liquid height was converted to volume based on empirical calibration data. The wells of the extreme perimeter of the plate showed a loss on volume of 20-50%, while the next wells in from the edge showed substantially no volume loss.

This measurement illustrates the advantages of the dummy or evaporation control well feature of a plate in accordance with a preferred embodiment, and the advantageous lid with flange 36 in accordance with preferred embodiments described above. That is, with the outer rows and columns of wells not being active wells, and instead being dummy wells or evaporation control wells, in accordance with a preferred embodiment, then any enhanced evaporation rate of liquid from these wells is eliminated as a fluorescence measurement problem because measurements from these wells are either not performed or not used in relevant calculations, data, results, etc. Moreover, the advantageous lid 24 of FIGS. 3*a*-3*b* as described above, e.g., provides that a plate 10 in accordance with a preferred embodiment will not experience as high an evaporation rate as conventional plates with simple lids.

Example 5

Screening Chemical Compounds for Enzyme Inhibitory Activity Using the Multi-Well Platform In this example, the multi-well plate was used as a spectrometric assay platform to screen chemical compounds for cytochrome P450 (CYP 3A4) isozyme inhibition. The isozyme is normally located in the liver, and it participates in the detoxification of hydrophobic drugs, carcinogens, and other potentially toxic compounds. Identification of CYP 3A4 inhibition is an important evaluation of the potential of a chemical compound as a therapeutic. This assay employs a fluorogenic substrate for CYP 3A4, benzyloxymethylresorufin (BOMR), e.g., described by Makings and Zlokarnik, 2003, "Optical molecular sensors for cytochrome P450 activity", U.S. Pat. No. 6,514,687. In aqueous solution, BOMR is nonfluorescent when excited at 530 nm and its emission at 605 nm is read. When the benzylmethylether moiety is cleaved from BOMR by CYP 3A4, free resorufin is produced, which fluoresces at 605 nm when excited at 530 nm. Thus, in the presence of a chemical compound that inhibits the activity of CYP 3A4, BOMR remains nonfluorescent.

The chemical compounds used for this screening assay were obtained from Chembridge Research Laboratories, Inc., San Diego, Calif. and maintained as concentrates at 100 μM in DMSO in a 3456-well source plate as described in accordance with a preferred embodiment. These compounds were dispensed to a second 3456-well plate, employed as an assay platform, using an array of 96 quartz microcapillaries connected to a positive displacement pump. The tip of each microcapillary was fitted with a slip-on molded polypropylene nozzle having an outer diameter of 1 mm to enable the nozzle to be inserted all the way to the bottom of a sample well in the platform. The microcapillary array was primed with DMSO. A 2 μL aliquot of each of 96 of the compounds in the source plate was aspirated into a microcapillary of the array using the positive displacement pump. The source plate was removed and the plate used as the assay platform was brought up to the microcapillary tips. Each microcapillary was fitted with a piezoelectric actuator that allowed the sample compound held in the nozzle to be dispensed as droplets with a volume of approximately 500 pL. Each compound was dispensed to 30 wells in the assay plate to cover a range of 10 concentrations of each compound in triplicate. These 30 wells were arranged in a grid of 6×6 wells to contain appropriate control wells and to enable interpretation of the resulting assay data. The 10 different concentrations were achieved by dispensing different numbers of drops to each well. The numbers of drops dispensed to each series of 10 wells were 2, 4, 8, 16, 32, 64, 128, 264, 512, or 1024 to provide compound concentrations in a 1.6 μL final volume of 0.04, 0.08, 0.16, 0.32, 0.64, 1.28, 2.56, 5.28, 10.24, or 20.48 μM. The DMSO was allowed to evaporate before the CYP 3A4 assay was run.

The assay was performed using recombinant human CYP 3A4 in a baculovirus vector that was used to transfect SF9 insect cells in which the membrane-bound cytochrome was expressed (Baculosomes, Panvera Corporation, Middleton, Wis.). The assay was constructed using the solenoid-metered pressure-driven dispensing system described above. The compounds were resuspended in a buffer containing 16.5 nM of CYP 3A4 isozyme in baculosomes, 100 mM potassium phosphate, 11 mM glucose-6-phosphate, 1.33 units/mL glucose-6-phosphate dehydrogenase, and 33.3 mM magnesium chloride, pH 8.0 contained in a volume of 1.0 μL added to each well. After 20 min incubation at 37° C., to redissolve the compounds and to allow them to interact with the isozyme, 0.6 μL of 50 μM BOMR, 1 mM nicotine adenine dinucleotide phosphate (NADP+) was added to each well, and the plate was incubated for an additional 45 min. The resorufin fluorescence was measured with a fluorescence microplate reader by using a 530 nm bandpass filter for excitation and 595 longpass filter for emission.

Results of the assay are now qualitatively discussed. Some of the compounds screened inhibited CYP 3A4 activity and these are depicted as 6×6 well grids with lightly grayed wells toward the upper left corner of each grid, where the wells with the greatest concentrations of each compound were located. Some of the grids contained chemical compounds known to inhibit CYP 3A4. The concentrations producing 50% inhibition were 30 nM for ketoconazole and 100 nM for miconazole. Potentiation of CYP 3A4 isozyme is seen in the grid located five grids from the left in the second row. This grid contained a concentration series of testosterone, which is a known activator of CYP 3A4.

This example shows that a multi-well platform in accordance with a preferred embodiment serves as both a storage plate in which chemical compounds are maintained while they are being formatted for an assay and a spectrometric assay plate from which quantitative pharmacological data can be obtained.

Example 6

Detection of an Activated Reporter Gene in a Cell Using the Multi-Well Platform In this example, a concentration response of carbachol in a Jurkat cell line stably transfected with a plasmid encoding the M1 muscarinic receptor and a NF-AT-β-lactamase reporter gene is obtained using the multi-well plate. In this transfected cell line, carbachol acts to stimulate the M1 muscarinic receptor so that the NFAT-β-lactamase reporter gene is expressed. When expressed, this gene produces β-lactamase which can then be detected using a fluorescent probe, such as CCF4-AM, that exhibits different emission wavelengths when intact and when cleaved by β-lactamase. CCF4 comprises two fluorescent moieties, a donor and an acceptor, covalently attached to each other by a cephalosporin linker, which is the substrate for the β-lactamase expressed in response to M1 receptor activation. When the donor moiety is excited by 400 nm light, its excitation energy is transferred to the linked acceptor moiety so that the donor emission at 460 nm is low and the emission from the sensitized acceptor at 530 nm is high. Cleavage of the linker by β-lactamase liberates the two fluorophores from CCF4, which decreases the transfer of energy from the donor to the acceptor so that the intensity of fluorescence at 460 nm is increased. Since the acceptor is no longer sufficiently close to the excited donor for efficient energy transfer, the acceptor fluorescence at 530 nm is decreased.

Jurkat cells used for this example were prepared by transfecting wild-type Jurkat cells with plasmid 3XNFAT-blax and then with pcDNA3-M1 (see description by Coassin et al., 2003, U.S. Pat. No. 6,517,781, incorporated by reference).

The assay was performed by first dispensing different amounts of carbachol from a stock solution of carbachol in RPMI buffer into different wells of a 3456 plate constructed as described in Example 1. The carbachol was distributed to half of the wells by using the acoustic lens dispensing system described in Example 4 and to the other half by the pressure-driven solenoid metered dispenser described in the same Example. The dispensing was controlled so that the wells contained 0.5 to 50 nL of stock carbachol solution, resulting in final well concentrations of 0.0016, 0.008, 0.04, 0.2, and 1.0 μM. Approximately 500 transfected Jurkat cells suspended in RPMI culture medium were dispensed to each well, and then the cells were incubated for 3 hr at 37° C. CCF4-AM was added to each well to yield a final concentration of 1 μM and the cells were incubated for an additional 20 min at 37° C. to allow endogenous esterases of the cells to cleave the acetoxy ester of CCF4-AM to produce the fluorescent CCF4. To read the assay, the bottom of each well was illuminated with light of 400 nm to excite the fluorescent donor moiety of CCF4, and then the emission of light at 460 and 530 nm was detected and measured through the bottom of the well.

This example reveals that a multi-well platform in accordance with a preferred embodiment is useful for quantitative spectrometric assays of pharmacological effects in cells.

Overall Assay System

The overall system preferably includes the following components:

§ Plate reader—This instrument can read the fluorescence signal in plates with up to 3456 wells. It can read two wavelengths simultaneously across an entire 3456-well plate in 2 minutes.

§ Microliter dispenser—This instrument can dispense volumes as low as 100 nL into plates with up to 3456 wells. It can fill a 3456-well plate with up to four reagents in 2 minutes.

§ Nanoliter dispenser—This instrument uses a focused acoustic beam to eject droplets as small as 2 nL directly from a storage (often called source) container onto a target. Both source and target are typically plates. It has the ability to dispense from any well of a storage plate into any well of the target plate. It can use plates with up to 3456 wells for either source or target. It can spot 3456 wells, each with 2 nL of a unique compound, in 16 minutes.

Additional details of the preferred systems may be found at U.S. provisional patent application Ser. No. 60/467,061 entitled, "Screening Devices", filed Apr. 30, 2003 by inventors Bennett, et al., and others of the patents cited herein, which are assigned to the same assignee as the present application and hereby incorporated by reference. With this system, not only can we run assays in high-density plates, but we can also store compounds in high-density plates. This presents a tremendous space advantage. For example, to store 100,000 compounds in 96-well plates requires over a thousand plates. The same number of compounds fits into about thirty 3456-well plates. A human being can easily handle thirty plates, whereas a thousand plates require a room-sized automated storage-and-retrieval system. Another advantage of storing compounds in high-density plates is the small volume of expensive compound required to make a useable source plate. For example, the nanoliter dispenser can dispense from a 3456-well source plate whose volume is between 0.5 and 2 uL. This means that with 2 uL of compound, we can deliver 10 nL to 150 separate target locations, wasting only 0.5 uL. In contrast, most other aspirate/dispense devices (including inkjet-type nanoliter dispensers) must aspirate at least 1 uL every time they dispense a new compound. Also, these types of pipetters require at least 5 uL of volume in the source well and can only access liquid in 96- or 384-well plates. A typical low-density source plate would be filled initially with about 50 uL so that it could be accessed at most 45 times, wasting 5 uL.

Both the reduced space requirements and the small liquid volume of high-density plates facilitate distribution of multiple copies of a compound library throughout an organization. The small space consumed allows an entire library to fit in a typical laboratory, and the low volume of compound required allows for many copies to be made, distributed, and replaced often. Instead of a centralized facility where all screening is performed, individual scientists have the ability to access the entire compound library and screen as they see fit. This setup avoids the transfer of an assay from the developer to the screener, which is notoriously difficult. Also, scientists are not subject to the restrictions that are placed by a centralized screening facility. They have the freedom to decide on things such as dispense volume and number of replicates.

While an exemplary drawings and specific embodiments of the present invention have been described and illustrated, it is to be understood that that the scope of the present invention is not to be limited to the particular embodiments discussed. Thus, the embodiments shall be regarded as illustrative rather than restrictive, and it should be understood that variations may be made in those embodiments by workers skilled in the arts without departing from the scope of the present invention as set forth in the appended claims and structural and functional equivalents thereof.

In addition, in methods that may be performed according to preferred embodiments herein and that may have been described above and in the claims below, the operations have been described in selected typographical sequences. However, the sequences have been selected and so ordered for typographical convenience and are not intended to imply any particular order for performing the operations.

What is claimed is:

1. A dual-use, high density plate for storage and assays, comprising:

a frame;

a matrix of more than 384 active wells defined by walls disposed within the frame and bottom portions, the walls and the bottom portions comprising one or more solvent-resistant materials;

a plurality of evaporation control wells defined by outer walls disposed within the frame outside of the active matrix and bottom portions, the evaporation control wells forming a ring around the active matrix, wherein the bottom portions of the evaporation control wells have greater thicknesses than the bottom portions of the active wells; and a lid, and further wherein the frame comprises a trough surrounding the ring of evaporation control wells, the trough extending along the edges of the plate and defined such that the lid comprising a protrusion disposed over the top portions of the wells forms a labyrinth with the trough.

2. The plate of claim 1, the one or more solvent-resistant materials comprising a dimethyl sulfoxide (DMSO)-resistant material.

3. The plate of claim 2, the DMSO-resistant material comprising cyclo-olefin polymer.

4. The plate of claim 2, the frame including the walls of the active wells also comprising a DMSO-resistant material.

5. The plate of claim 1, the evaporation control wells being further defined by bottom portions not comprising the same DMSO-resistant material as bottom portions of active wells.

6. The plate of claim 5, the bottom portions of the evaporation control wells comprising a material that is substantially opaque to screening wavelengths between 200 nm and 800 nm.

7. The plate of claim 6, the screening wavelengths being between 230 nm and 350 nm.

8. The plate of claim 6, the screening wavelengths being between 330 nm and 600 nm.

9. The plate of claim 5, the bottom portions of the evaporation control wells comprising part of the frame.

10. The plate of claim 5, the bottom portions of the evaporation control wells comprising a same material as the outer walls defining the evaporation control wells.

11. The plate of claim 10, the bottom portions and the outer walls defining the evaporation control wells being integrally formed of a unitary construction with the plate.

12. The plate of claim 1, the solvent-resistant material being substantially transparent to screening wavelengths between 200 nm and 800 nm.

13. The plate of claim 12, the screening wavelengths being between 230 nm and 350 nm.

14. The plate of claim 12, the screening wavelengths being between 330 nm and 600 nm.

15. The plate of claim 1, the bottom portions remaining substantially flat at temperatures greater than 110° C.

16. The plate of claim 1, the bottom portions remaining substantially flat at temperatures of approximately 127° C. or more.

17. The plate of claim 1, each active well defining an interior volume of not substantially more than approximately 2 microliters.

18. A dual-use, high density plate for storage and assays, comprising:

a frame;

a plurality of optical fiducials within the frame for reflecting light from a light source for a camera;

a matrix of more than 384 active wells separated by walls and disposed within the frame;

bottom portions of the active wells comprising a solvent-resistant material;

a plurality of evaporation control wells defined by outer walls disposed within the frame outside of the matrix of active wells and bottom portions, the evaporation control wells forming a ring around the active matrix, wherein the bottom portions of the evaporation control wells have greater thicknesses than the bottom portions of the active wells; and a lid, and further wherein the frame comprises a trough surrounding the ring of evaporation control wells, the trough extending along the edges of the plate and defined such that the lid comprising a protrusion disposed over the top portions of the wells forms a labyrinth with the trough.

19. The plate of claim 18, further comprising at least three pairs of gripping notches arranged around a periphery of the frame for mating with gripper fingers of a gripping device.

20. The plate of claim 18, the optical fiducials having a convex shape with respect to the light source.

21. The plate of claim 18, the optical fiducials being molded portions of the frame.

22. The plate of claim 18, the optical fiducials being disposed approximately at corner portions of the frame.

23. The plate of claim 18, the solvent-resistant material being substantially transparent to screening wavelengths between 200 nm and 800 nm.

24. The plate of claim 23, the screening wavelengths being between 230 nm and 350 nm.

25. The plate of claim 23, the screening wavelengths being between 330 nm and 600 nm.

26. The plate of claim 18, the bottom portions remaining substantially flat at temperatures greater than 110° C.

27. The plate of claim 18, the bottom portions remaining substantially flat at temperatures of approximately 127° C. or more.

28. The plate of claim 18, each active well defining an interior volume of not substantially more than approximately 2 microliters.

29. The plate of claim 18, further comprising at least three pairs of gripping notches arranged around a periphery of the frame for mating with gripper fingers of a gripping device.

30. The plate of claim 18, the solvent-resistant material comprising a dimethyl sulfoxide (DMSO)-resistant material.

31. The plate of claim 30, the DMSO-resistant material comprising cyclo-olefin polymer.

32. The plate of claim 30, the frame including the walls of the wells also comprising a DMSO-resistant material.

33. A dual-use, high density plate for storage and assays, comprising:

a frame;

a matrix of more than 384 active wells separated by walls and disposed within the frame, top portions of the wells being arranged at least approximately flush with a plane of the frame;

bottom portions of the wells comprising a solvent-resistant material;

a plurality of evaporation control wells defined by outer walls disposed within the frame outside of the matrix of active wells and bottom portions, the evaporation control wells forming a ring around the active matrix, wherein the bottom portions of the evaporation control wells have greater thicknesses than the bottom portions of the active wells; and a lid, and further wherein the frame comprises a trough surrounding the ring of evaporation control wells, the trough extending along the edges of the plate and defined such that the lid comprising a protrusion disposed over the top portions of the wells forms a labyrinth with the trough.

34. The plate of claim 33, the solvent-resistant material comprising a dimethyl sulfoxide (DMSO)-resistant material.

35. The plate of claim 34, the DMSO-resistant material comprising cyclo-olefin polymer.

36. The plate of claim 34, the frame including the walls of the wells also comprising a DMSO-resistant material.

37. The plate of claim 33, further comprising a plurality of optical fiducials within the frame for reflecting light from a light source for a camera.

38. The plate of claim 37, the solvent-resistant material being substantially transparent to screening wavelengths between 200 nm and 800 nm.

39. The plate of claim 38, the screening wavelengths being between 230 nm and 350 nm.

40. The plate of claim 38, the screening wavelengths being between 330 nm and 600 nm.

41. The plate of claim 37, the bottom portions remaining substantially flat at temperatures greater than 110° C.

42. The plate of claim 37, the bottom portions remaining substantially flat at temperatures of approximately 127° C. or more.

43. The plate of claim 37, each active well defining an interior volume of not substantially more than approximately 2 microliters.

44. A method of performing an assay using a high density plate, the plate including a lid, a frame, a matrix of more than 384 active wells separated by walls and disposed within the frame, and a layer of a solvent-resistant material forming bottom portions of the wells, the method comprising the steps of:

employing peripheral wells as evaporation control wells defined by outer walls disposed within the frame outside of the matrix of active wells and bottom portions, the evaporation control wells forming a ring around the active matrix, wherein the bottom portions of the evaporation control wells have greater thicknesses than the bottom portions of the active wells, and further wherein the frame comprises a trough surrounding the ring of evaporation control wells, the trough extending along the edges of the plate and defined such that the lid comprising a protrusion disposed over the top portions of the wells forms a labyrinth with the trough;

performing the assay; and analyzing data from measurements performed on the wells other than the evaporation control wells.

45. The method of claim 44, measurements having been performed using the evaporation control wells, the analyzing step excluding those measurements.

46. The method of claim 44, measurements not having been performed using the evaporation control wells.

47. The method of claim 44, the evaporation control wells being substantially geometrically identical to other wells.

48. The method of claim 44, bottom portions of the evaporation control wells having been manufactured as part of the frame.

49. The method of claim 44, bottom portions in part defining the evaporation control wells comprising a same material as walls also in part defining the evaporation control wells.

50. The method of claim 44, bottom portions and walls defining the evaporation control wells being integrally formed of a unitary construction.

51. The method of claim 44, the plate further comprising a plurality of optical fiducials, the method further comprising reflecting light from a light source for a camera from the plurality of optical fiducials.

52. The method of claim 51, further comprising the step of referring to a registry of frame images to identify the plate based on the optical fiducials.

53. The method of claim 44, the solvent-resistant material comprising a dimethyl sulfoxide (DMSO)-resistant material.

54. The method of claim 53, the DMSO-resistant material comprising cyclo-olefin polymer.

55. The method of claim 53, the frame including the walls of the wells also comprising a DMSO-resistant material.

56. A multi-well plate, comprising:

a frame;

a matrix of more than 384 active wells defined by walls disposed within the frame and bottom portions comprising a cyclo-olefin polymer comprising cycloalkane and polyethylene monomers polymerized catalyst-free with thermally activated moieties functionalized to the monomers;

a plurality of evaporation control wells defined by outer walls disposed within the frame outside of the matrix of active wells and bottom portions, the evaporation control wells forming a ring around the active matrix, wherein the bottom portions of the evaporation control wells have greater thicknesses than the bottom portions of the active wells; and a lid, and further wherein the frame comprises a trough surrounding the ring of evaporation control wells, the trough extending along the edges of the plate and defined such that the lid comprising a protrusion disposed over the top portions of the wells forms a labyrinth with the trough.

57. The plate of claim 56, the cyclo-olefin polymer having a less than 1% change in transmittance upon exposure to steam.

58. The plate of claim 56, the cyclo-olefin polymer having a less than 0.5 $gm/m^2$ per 24 hr water vapor permeability.

59. The plate of claim 56, the cyclo-olefin polymer having a tensile modulus greater than 1 GPa.

60. The plate of claim 56, the cyclo-olefin polymer having a mold shrinkage of 0.6% or less.

61. The plate of claim 56, the cyclo-olefin polymer having a melt viscosity less than 2000 Pa-s at a shear rate of 10/s at 200° C.

62. The plate of claim 56, the cyclo-olefin polymer having a water contact angle greater than 90° of arc.

63. The plate of claim 56, the cyclo-olefin polymer having a heat distortion temperature of more than 110° C.

64. The plate of claim 56, the cyclo-olefin polymer having a heat distortion temperature of more than 120° C.

65. The plate of claim 56, the cyclo-olefin polymer having a heat distortion temperature of more than 125° C.

66. The plate of claim 56, the cyclo-olefin polymer having a heat distortion temperature of substantially 127° C. or more.

67. A multi-well plate, comprising:

a frame;

a matrix of more than 384 active wells defined by walls disposed within the frame and bottom portions comprising one or more DMSO-resistant materials having a heat distortion temperature of more than 110° C.;

a plurality of evaporation control wells defined by outer walls disposed within the frame outside of the matrix of active wells and bottom portions, the evaporation control wells forming a ring around the active matrix, wherein the bottom portions of the evaporation control wells have greater thicknesses than the bottom portions of the active wells; and a lid, and further wherein the frame comprises a trough surrounding the ring of evaporation control wells, the trough extending along the edges of the plate and defined such that the lid comprising a protrusion disposed over the top portions of the wells forms a labyrinth with the trough.

68. The plate of claim 67, the one or more DMSO-resistant materials comprising cyclo-olefin polymer.

69. The plate of claim 67, the one or more DMSO-resistant materials having a heat distortion temperature of more than 120° C.

70. The plate of claim 69, the one or more DMSO-resistant materials comprising cyclo-olefin polymer.

71. The plate of claim 67, the one or more DMSO-resistant materials having a heat distortion temperature of more than 125° C.

72. The plate of claim 71, the one or more DMSO resistant materials comprising cyclo-olefin polymer.

73. The plate of claim 67, the one or more DMSO-resistant materials having a heat distortion temperature of substantially 127° C. or more.

74. The plate of claim 73, the one or more DMSO-resistant materials comprising cyclo-olefin polymer.

75. A multi-well plate, comprising:

a frame;

a matrix of more than 384 active wells defined by walls disposed within the frame and bottom portions comprising a cyclo-olefin polymer having an absorbance of 0.1/mm or less at wavelengths in a range between 230 nm and 280 nm;

a plurality of evaporation control wells defined by outer walls disposed within the frame outside of the matrix of active wells and bottom portions, the evaporation control wells forming a ring around the active matrix, wherein the bottom portions of the evaporation control wells have greater thicknesses than the bottom portions of the active wells; and a lid, and further wherein the frame comprises a trough surrounding the ring of evaporation control wells, the trough extending along the edges of the plate and defined such that the lid comprising a protrusion disposed over the top portions of the wells forms a labyrinth with the trough.

76. The plate of claim 75, the cyclo-olefin polymer having a less than 1% change in transmittance upon exposure to steam.

77. The plate of claim 75, the cyclo-olefin polymer having a less than 0.5 gm/m$^2$ per 24 hr water vapor permeability.

78. The plate of claim 75, the cyclo-olefin polymer having a tensile modulus greater than 1 GPa.

79. The plate of claim 75, the cyclo-olefin polymer having a mold shrinkage of 0.6% or less.

80. The plate of claim 75, the cyclo-olefin polymer having a melt viscosity less than 2000 Pa-s at a shear rate of 10/s at 200° C.

81. The plate of claim 75, the cyclo-olefin polymer having a water contact angle greater than 90° of arc.

82. The plate of claim 75, the cyclo-olefin polymer having a heat distortion temperature of more than 110° C.

83. The plate of claim 75, the cyclo-olefin polymer having a heat distortion temperature of more than 120° C.

84. The plate of claim 75, the cyclo-olefin polymer having a heat distortion temperature of more than 125° C.

85. The plate of claim 75, the cyclo-olefin polymer having a heat distortion temperature of substantially 127° C. or more.

86. A multi-well plate, comprising:

a frame;

a matrix of more than 384 active wells defined by walls disposed within the frame and bottom portions comprising a cyclo-olefin polymer having an absorbance of 0.05/mm or less at wavelengths of 280 nm or more;

a plurality of evaporation control wells defined by outer walls disposed within the frame outside of the matrix of active wells and bottom portions, the evaporation control wells forming a ring around the active matrix, wherein the bottom portions of the evaporation control wells have greater thicknesses than the bottom portions of the active wells; and a lid, and further wherein the frame comprises a trough surrounding the ring of evaporation control wells, the trough extending along the edges of the plate and defined such that the lid comprising a protrusion disposed over the top portions of the wells forms a labyrinth with the trough.

87. The plate of claim 86, the cyclo-olefin polymer having a less than 1% change in transmittance upon exposure to steam.

88. The plate of claim 86, the cyclo-olefin polymer having a less than 0.5 gm/m$^2$ per 24 hr water vapor permeability.

89. The plate of claim 86, the cyclo-olefin polymer having a tensile modulus greater than 1 GPa.

90. The plate of claim 86, the cyclo-olefin polymer having a mold shrinkage of 0.6% or less.

91. The plate of claim 86, the cyclo-olefin polymer having a melt viscosity less than 2000 Pa-s at a shear rate of 10/s at 200° C.

92. The plate of claim 86, the cyclo-olefin polymer having a water contact angle greater than 90° of arc.

93. The plate of claim 86, the cyclo-olefin polymer having a heat distortion temperature of more than 110° C.

94. The plate of claim 86, the cyclo-olefin polymer having a heat distortion temperature of more than 120° C.

95. The plate of claim 86, the cyclo-olefin polymer having a heat distortion temperature of more than 125° C.

96. The plate of claim 86, the cyclo-olefin polymer having a heat distortion temperature of substantially 127° C. or more.

97. A multi-well plate, comprising:

a frame;

a matrix of more than 384 active wells defined by walls disposed within the frame and bottom portions comprising a cyclo-olefin polymer, the bottoms portions having a thickness of 1 mm or less and a transmittance per mm of 40% or more at wavelengths in a range between 220 nm and 260 nm;

a plurality of evaporation control wells defined by outer walls disposed within the frame outside of the matrix of active wells and bottom portions, the evaporation control wells forming a ring around the active matrix, wherein the bottom portions of the evaporation control wells have greater thicknesses than the bottom portions of the active wells; and a lid, and further wherein the frame comprises a trough surrounding the ring of evaporation control wells, the trough extending along the edges of the plate and defined such that the lid comprising a protrusion disposed over the top portions of the wells forms a labyrinth with the trough.

98. The plate of claim 97, the bottoms of the active wells having a thickness between 50 μm and 300 μm.

99. The plate of claim 97, the cyclo-olefin polymer having a less than 1% change in transmittance upon exposure to steam.

100. The plate of claim 97, the cyclo-olefin polymer having a less than 0.5 gm/m$^2$ per 24 hr water vapor permeability.

101. The plate of claim 97, the cyclo-olefin polymer having a tensile modulus greater than 1 GPa.

102. The plate of claim 97, the cyclo-olefin polymer having a mold shrinkage of 0.6% or less.

103. The plate of claim 97, the cyclo-olefin polymer having a melt viscosity less than 2000 Pa-s at a shear rate of 10/s at 200° C.

104. The plate of claim 97, the cyclo-olefin polymer having a water contact angle greater than 90° of arc.

105. The plate of claim 97, the cyclo-olefin polymer having a heat distortion temperature of more than 110° C.

106. The plate of claim 97, the cyclo-olefin polymer having a heat distortion temperature of more than 120° C.

107. The plate of claim 97, the cyclo-olefin polymer having a heat distortion temperature of more than 125° C.

108. The plate of claim 97, the cyclo-olefin polymer having a heat distortion temperature of substantially 127° C. or more.

109. A multi-well plate, comprising:

a frame;

a matrix of more than 384 active wells defined by walls disposed within the frame and bottom portions comprising a cyclo-olefin polymer, the bottom portions having a thickness of 1 mm or less and a transmittance per mm of 80% or more at wavelengths of 260 nm or more;

a plurality of evaporation control wells defined by outer walls disposed within the frame outside of the matrix of active wells and bottom portions, the evaporation control wells forming a ring around the active matrix, wherein the bottom portions of the evaporation control wells have greater thicknesses than the bottom portions of the active wells; and a lid, and further wherein the frame comprises a trough surrounding the ring of evaporation control wells, the trough extending along the edges of the plate and defined such that the lid comprising a protrusion disposed over the top portions of the wells forms a labyrinth with the trough.

110. The plate of claim 109, the bottoms of the active wells having a thickness between 50 μm and 300 μm.

111. The plate of claim 109, the cyclo-olefin polymer having a less than 1% change in transmittance upon exposure to steam.

112. The plate of claim 109, the cyclo-olefin polymer having a less than 0.5 gm/m$^2$ per 24 hr water vapor permeability.

113. The plate of claim 109, the cyclo-olefin polymer having a tensile modulus greater than 1 GPa.

114. The plate of claim 109, the cyclo-olefin polymer having a mold shrinkage of 0.6% or less.

115. The plate of claim 109, the cyclo-olefin polymer having a melt viscosity less than 2000 Pa-s at a shear rate of 10/s at 200° C.

116. The plate of claim 109, the cyclo-olefin polymer having a water contact angle greater than 90° of arc.

117. The plate of claim 109, the cyclo-olefin polymer having a heat distortion temperature of more than 110° C.

118. The plate of claim 109, the cyclo-olefin polymer having a heat distortion temperature of more than 120° C.

119. The plate of claim 109, the cyclo-olefin polymer having a heat distortion temperature of more than 125° C.

120. The plate of claim 109, the cyclo-olefin polymer having a heat distortion temperature of substantially 127° C. or more.

121. A multi-well plate, comprising:

a frame;

a matrix of more than 384 active wells defined by walls disposed within the frame and bottom portions comprising a same solvent resistant material, except that said walls are rendered opaque at screening wavelengths by exposure to air at substantially 200° C. or higher, or adding dark pigment, or a combination thereof, and said bottoms of said wells have a transmittance of 40% or more at screening wavelengths of 220 nm or more and having a thickness of 1 mm or less, and wherein the plate further comprises a flange at a periphery of the matrix of wells extending beyond the bottom portions of the active wells;

a plurality of evaporation control wells defined by outer walls disposed within the frame outside of the matrix of active wells and bottom portions, the evaporation control wells forming a ring around the matrix of active wells, wherein the bottom portions of the evaporation control wells have greater thicknesses than the bottom portions of the active wells; and a lid, and further wherein the frame comprises a trough surrounding the ring of evaporation control wells, the trough extending along the edges of the plate and defined such that lid comprising a protrusion disposed over the top portions of the wells forms a labyrinth with the trough.

122. The plate of claim 121, the dark pigment comprising carbon black particles at a weight percentage ranging between 0.5% and 15%.

123. The plate of claim 121, the exposure to air being followed by quenching with molecular nitrogen.

124. The plate of claim 121, the plate being formed by injection molding.

125. The plate of claim 121, center-to-center distances between adjacent wells being greater than diameters of wells.

126. The plate of claim 125, the matrix comprising substantially 3456 wells, the center-to-center distances being approximately 1.3 mm, and said diameters being approximately 1.03 mm.

127. The plate of claim 125, the matrix comprising substantially 1536 wells, the center-to-center distances being approximately 2.25 mm, and said diameters being approximately 1.8 mm.

128. The plate of claim 125, the matrix comprising substantially 3456 wells or more, the center-to-center distances being approximately 1.3 mm or less, and said diameters being approximately 1.03 mm or less.

129. The plate of claim 125, the matrix comprising substantially 1536 wells or more, the center-to-center distances being approximately 2.25 mm or less, and said diameters being approximately 1.8 mm or less.

130. The plate of claim 121, the plate having a thickness in a range between 0.5 mm and 14 mm.

131. The plate of claim 130, the plate having a thickness substantially around 3 mm.

132. The plate of claim 130, the wells having a draft angle substantially around 2° or more.

133. The plate of claim 121, the solvent-resistant material having a less than 1% change in transmittance upon exposure to steam.

134. The plate of claim 121, the solvent-resistant material having a less than 0.5 $gm/m^2$ per 24 hr water vapor permeability.

135. The plate of claim 121, the solvent-resistant material having a tensile modulus greater than 1 GPa.

136. The plate of claim 121, the solvent-resistant material having a mold shrinkage of 0.6% or less.

137. The plate of claim 121, the solvent-resistant material having a melt viscosity less than 2000 Pa-s at a shear rate of 10/s at 200° C.

138. The plate of claim 121, the solvent-resistant material having a water contact angle greater than 90° of arc.

139. The plate of claim 121, the solvent-resistant material having a heat distortion temperature of more than 110° C.

140. The plate of claim 121, the solvent-resistant material having a heat distortion temperature of more than 120° C.

141. The plate of claim 121, the solvent-resistant material having a heat distortion temperature of more than 125° C.

142. The plate of claim 121, the solvent-resistant material having a heat distortion temperature of substantially 127° C. or more.

143. A multi-well plate, comprising:

a frame;

a matrix of more than 384 active wells defined by walls disposed within the frame and bottom portions comprising a same solvent resistant material, except that the walls are rendered opaque at screening wavelengths, and the bottoms of the wells have a transmittance of 40% or more at screening wavelengths of 220 nm or more and having a thickness of 1 mm or less;

a plurality of evaporation control wells defined by outer walls disposed within the frame outside of the matrix of active wells and bottom portions, the evaporation control wells forming a ring around the active matrix, wherein the bottom portions of the evaporation control wells have greater thicknesses than the bottom portions of the active wells; and a lid, and further wherein the frame comprises a trough surrounding the ring of evaporation control wells, the trough extending along the edges of the plate and defined such that the lid comprising a protrusion disposed over the top portions of the wells forms a labyrinth with the trough.

144. The plate of claim 143, the walls being rendered opaque by adding a dark pigment comprising carbon black particles at a weight percentage ranging between 0.5% and 15%.

145. The plate of claim 143, the walls being rendered opaque by exposure to air being followed by quenching with molecular nitrogen.

* * * * *